United States Patent [19]

McClay et al.

[11] Patent Number: 4,620,656

[45] Date of Patent: Nov. 4, 1986

[54] AUTOMATIC RIVET-FEEDING SYSTEM FOR RELIABLE DELIVERY OF PLURAL RIVET SIZES

[75] Inventors: Archie R. McClay; Raymond H. Billington, both of Huntington Beach; Chester W. Ruckman, Covina, all of Calif.

[73] Assignee: Herbert L. Engineering Corp., Frederick, Md.

[21] Appl. No.: 483,487

[22] Filed: Apr. 11, 1983

[51] Int. Cl.[4] ..... B21J 15/28

[52] U.S. Cl. ..... 227/5; 221/64; 227/51; 227/69; 406/74

[58] Field of Search ..... 221/176, 224, 264, 128, 221/268, 278; 227/5, 51, 69, 109, 111, 119, 149; 72/453.19; 406/72, 74, 117

[56] References Cited

U.S. PATENT DOCUMENTS

| | | | |
|---|---|---|---|
| 3,030,695 | 4/1962 | White et al. | 227/69 |
| 3,030,832 | 4/1962 | Filangeri et al. | 227/5 |
| 3,534,896 | 10/1970 | Speller et al. | 227/51 |
| 3,554,403 | 1/1971 | Ginther | 221/64 X |
| 4,180,195 | 12/1979 | Caley et al. | 227/51 |
| 4,208,153 | 6/1980 | Trethewy | 406/74 |
| 4,220,275 | 9/1980 | Hametner et al. | 227/5 |
| 4,463,889 | 8/1984 | Sartran | 227/112 |
| 4,487,355 | 12/1984 | Ginnow et al. | 227/112 |

FOREIGN PATENT DOCUMENTS

| | | | |
|---|---|---|---|
| 914811 | 7/1954 | Fed. Rep. of Germany | 227/51 |

*Primary Examiner*—Paul A. Bell

*Attorney, Agent, or Firm*—Peter I. Lippman

[57] ABSTRACT

This system selects and delivers a rivet of correct size for workpiece thickness at each rivet location. Positive control of rivet orientation is provided at the crucial junction point of plural supply paths with the delivery path to the riveting machine. This is done by a simplified modular device, called a "transfer station," which hands off one rivet from the correct supply path to the delivery path, on demand by a measuring device. Positive rivet-orientation control is also provided everywhere else in the system, including the escapements and the injector—making it feasible to use a pneumatic tube for delivery to the injector. Thus only the measuring device and injector need be mounted to the installing head of the riveter. Orientation at the escapement is fixed by a dual-blade mechanism that constrains each rivet shank, keeping the rivet from toppling head-first into a pneumatic supply tube to the transfer station. A two-stage mechanism at the injector fixes rivet orientation by delivering each rivet just below the installing head at a shallow angle.

26 Claims, 21 Drawing Figures

AUTOMATIC RIVET-FEEDING SYSTEM FOR RELIABLE DELIVERY OF PLURAL RIVET SIZES

BACKGROUND

1. Field of the Invention

This invention relates generally to systems for feeding or delivering rivets from supply bowls or the like to the installing heads of riveting machines, and more particularly to automatic systems for delivering rivets of various sizes and types for installation in workpieces having correspondingly various thicknesses and other parameters.

2. Prior Art (a) Generally—Prior art in this field is rather limited, because automatic rivet selection has only become of interest in recent years. Two factors account for the recent attention to automatic selection: tighter tolerances, and the availability of automatic measurements.

The requirement for closer tolerances arises from the recent development of more-sophisticated fasteners (some, for example, with spin-on nuts), whose length must more closely match the workpiece thickness. Automatic measurements are the result of the computerization of industry in general, though it must be noted that in the riveting industry—before the improved measurement techniques of the present invention—automatic measurements have not been fully satisfactory.

In any case, earlier automatic rivet-feeding systems have been plagued by unreliability, or by the need for manual performance of certain parts of the delivery sequence, or by both.

Some attempts to overcome these aggravations have identified pneumatic delivery as a source of unreliability, and accordingly have eliminated pneumatic delivery and have focused on minimization of the delivery-path length. One key result—as explained below—has been a clutter of feed-system parts in the immediate vicinity of the installing head of the riveting machine.

Such misallocation of the work space, in turn, produces severe inaccessibility of both the installing head and the workpiece, as well as very considerable inconvenience in servicing and resupply of the feeding system itself. (Typically, access to the feeding system requires the technician to clamber over the workpiece, incurring the additional risk of damaging it with dropped tools or equipment.) With some workpieces having strongly contoured shapes—such as aircraft nacelles—that curve upward from the riveting site, the clutter of feed-system parts around the riveting head can be simply prohibitive. That is to say, such feed-system parts can positively obstruct the workpiece, and thus render the system unusable for such workpieces.

Another pervasive feature of prior systems has been the practice of taking measurements of workpiece thickness at a hole *adjacent* to the one in which the corresponding rivet will be installed. There has never been any real physical reason for this practice as applied to automatic feeding systems, but it has grown up as standard practice in the riveting industry.

More specifically, this practice originated before automatic feeding systems came into use, when changing rivet sizes was a relatively time-consuming matter. In that context, it appeared reasonable to deliver a rivet *in advance*, via an injector to the gripping fingers of the riveting machine, so that once the rivet hole was drilled the rivet could be installed and upset without further delay. By using advance delivery, designers made it unnecessary to wait for measurement, rivet-size selection, and feeding-system manipulation, before the rivet could be driven home. The most practical way in which this could be accomplished was to use each measurement to select a rivet for use in the next succeeding hole.

This latter practice, of course, depends heavily on the wishful premise that the workpiece thickness does not vary abruptly. In some commonplace industrial applications, there are occasional transverse pieces to be riveted to the main workpiece—such as the stabilizing elements ("stringers") at intervals along aircraft wings. Such cases of course entail gross departures from the premise that there are no abrupt thickness variations. Dealing with such gross departures, when using an adjacent-measurement system, requires woefully elaborate programming or other provisions.

The measurement of workpiece thickness (and/or other parameters) has been subject also to its own problems, in addition to or perhaps merely aggravated by the excessive crowding of components at the riveter head. Such few automatic measurement systems as have appeared commercially have been extremely inconvenient in use, primarily by virtue of having fixed "reference" or "tooling zero" positions.

In such measurement systems the nominal "zero-thickness" position of the probe that measures workpiece thickness is fixed in relation to stationary components (such as the riveter "C"-frame and housing). This fixed relationship is at odds with the variability of tooling for various jobs, including tooling components both above the workpiece (such as the "pressure-foot bushing" used in most riveters) and below.

Consequently a fixed-reference system renders a routine tool change, or even a tool adjustment, a major operation. Such routine procedures, with a fixed-reference system, require readjustment of the entire measurement sensor—and access to that device is often very awkward.

Even with all these adverse side-effects, however, the primary problems of reliability and/or of necessity for manual operations have remained.

(b) Tube systems—The difficulties with pneumatic delivery, and with both tube-storage and tube-delivery systems generally, can be classified into two types—jamming of multiple rivets in a tube, and jamming at intersection points. As to the first of these, it has been established rather definitely that accumulation of multiple rivets above a release pin or gate produces almost invariably a rivet-jam of one kind or another. This fact has given tube systems a bad name, which is quite justified with respect to tube *storage* of rivets. Its application, however, to tube *transport* of rivets has been somewhat unreasoning, since this type of jam is avoidable in systems transporting only one rivet at a time.

Jamming at intersection points is another matter. Such intersection points include intersections between a tube and the device at either end, and also points of convergence between two or more tubes as in a tube-type manifold. Prior attempts to use tube transport systems have almost all faltered over this group of problems, and particularly over the tendency of rivets to tumble into unanticipated transverse (or inverted) orientations when dropped or blown into or out of a tube, or when traversing an area of convergence between two tubes.

Frustration with these pervasive problems has led to some tendency for a teaching, in the prior art, away from tube transport of rivets and toward track transport.

In particular, efforts to provide reliable "escapements" (devices for moving rivets from storage containers called "feeder bowls" into supply paths) in pneumatic-transport systems have been unsatisfactory. For example, conventional escapements rely on a single-blade shuttle to contact each rivet by its shank and to carry it to the entry point of a supply tube. These escapements fail to establish reliable orientation control.

In one relatively advanced system the escapement proper ejected rivets onto a short section of track; the rivets slid on the track to a tube, into which they were "vacuumed" by a Venturi construction. The air-flow adjustment, even with this elaborate arrangement, was very critical, and the entire device accordingly was very "fussy." Taking the temperamental and somewhat unstable character of the air adjustment into consideration, even this advanced system must be regarded as relatively unreliable.

(c) Track systems—The use of track transport, however, has been fraught with its own drawbacks. Rivets are lightweight and slide along such tracks under the influence of gravity, so there are inherent tradeoffs between delivery time, physical length of the delivery path, the height of the supply bowls and manifold above the riveter, and the need to keep the tracks clean, free of corrosion, and unkinked.

The solution to this multidimensional problem has most popularly taken the form of short, very steep tracks—requiring all the equipment to be clustered rather closely about the riveter head, with the severe disadvantages already noted.

Other disadvantages of track systems include inflexibility, with respect to rearrangement of equipment when workpiece types are changed. Running successive jobs that require substantially different combinations of rivet types and sizes therefore entails major delay and expense, as skilled personnel rearrange and modify the tracks and the associated devices.

Track systems, furthermore, generally make use of an upper or retainer track to keep rivet heads from leaving the guide tracks. The spacing between the retainer track and the guide tracks must be relatively close, if the retainer track is to do its job, but must not be too close, lest rivet heads bind between the two tracks at very minor kinks in the track structure. This set of interrelated constraints makes track systems very temperamental, since minor kinks can be almost unnoticeable except by binding of rivets in them; and also makes track systems relatively inflexible as to the capability of transporting rivets of different head sizes.

The transverse space between the guide tracks is similarly "fussy," resulting in inflexibility of track systems as to the capability of transporting rivets of different diameters. Such inflexibility may of course be cured by using track structures with adjustable separations between the guide tracks, but this adds to the expense and to all the other difficulties already outlined.

Yet even this severely adverse set of compromises has not sufficed to resolve the problems of convergence from several supply bowls, containing rivets of different sizes, to a common delivery path. Tracks, like tubes, have open spaces at points of convergence, and these open spaces are virtual invitations to tumbling or twisting—and, consequently, jamming.

As a result, some commercial systems actually call for the equipment operator to shift the "upstream" end of a delivery track from one supply track to another manually, as the workpiece requires rivet-size changes. In some cases the operator must actually remove the workpiece to effect a rivet-size change. Others may call for the operator to operate a control which effects this repositioning by motor or solenoid, but the adequacy of this approach is questionable in view of the temperamental character of tracks at junction points.

Most or all conventional escapement mechanisms only contact the bodies of the rivets, and often allow rivets to fall—sometimes inverted—by sideward motion into the track.

(d) Transfer stations—Some recently innovative systems have introduced specialized apparatus designed to achieve positive control of rivet orientation at the junction point of several supply paths with a common delivery path to the riveting machine—that is to say, at the point where any one of various supply paths from various storage bowls must be selectively extendable to an injector. The apparatus introduced for this purpose hands off one rivet of the required size from the appropriate supply path to the delivery path. Such a device may be called a "transfer station."

One prior-art transfer station, reportedly introduced by the Gemcor corporation, consists of a unitary long block with a hole drilled all the way through it in the long dimension, and a number of small turntables—with rotational axes perpendicular to that of the long hole—arrayed along the hole and intersecting it. The number of turntables is rather high, sixteen being apparently a customary number.

Each turntable has a pair of holes drilled through it along diameters. These holes intersect each other in the center of the turntable. When a particular turntable is in place in the block the turntable is rotatable to bring either of the diametral holes into alignment with the through-hole in the block.

In addition, the block has a number of lateral port holes through which rivets may be introduced, and these port holes are positioned so that their axes intersect the lengthwise hole through the block at the turntable centers. The angle between each port-hole axis and the lengthwise-hole axis is—after the system has been aligned—equal to the angle between the two diametral holes in the corresponding turntable. By virtue of this equality, the turntable is positionable so that one of the diametral holes is aligned with the lengthwise hole in the block and the other of the diametral holes is aligned with the corresponding lateral port hole. These two holes will be called the "first diametral hole" and "second diametral hole" respectively, in the rest of this discussion.

When all the turntables are aligned in just this way, the second diametral hole of each turntable can receive a rivet from a supply tube, so that there is a rivet waiting in each turntable. By virtue of a stationary split stop pin placed near the center of each turntable, however, the rivets do not extend into the lengthwise hole in the block; thus the first diametral holes of all the turntables are unobstructed, and form with the lengthwise hole in the block a straight transfer path from one end of the block to the other.

When a particular turntable is rotated so that its *second* diametral hole is aligned with the lengthwise hole in the block, the rivet in that turntable is able to bypass the split stop pin and pass out of the turntable into the lengthwise hole in the block. Transport air is introduced at one end of the block to facilitate this passage. The rivet is blown through the lengthwise hole in the block to a delivery path—that is, to a path that leads to an injector adjacent to the riveting machine. This path is at the end of the block opposite that at which the air is introduced.

Rivets in the turntable that is nearest the delivery-path end of the block must pass only through a short section of the lengthwise hole in the block to reach the delivery path. Successful transfer of such a rivet therefore depends upon the accuracy of alignment of the first diametral hole in the turntable with the lengthwise hole in the block. This alignment accordingly must be adjusted carefully when the system is set up, and the adjustment maintained during operation.

In addition, the lateral input port in the block should be made adjustable to align with the second diametral hole in the turntable. (Alternatively, extremely high-precision machining of the block and all the turntables could be used, to eliminate the necessity for adjustability of the lateral input port holes. The cost of this approach, however, would be more onerous than the requirement of providing and using adjustable ports.)

Thus this particular turntables can be used to successfully deliver to rivet of some one sizes, relying only upon two adjustments—generally a satisfactory state of affairs. For all other turntables, however, a discharged rivet must pass through all the other downstream turntables, so that the rivet at the transport-air end (or "upstream end") of the lengthwise hole must negotiate all sixteen of the first diametral holes to reach the delivery end. Delivering a rivet from the upstream turntable consequently depends upon the alignment adjustment of all sixteen of the first diametral holes, plus the alignment adjustment of the lateral port hole to the second diametral hole of the upstream turntable: seventeen independent adjustments in all.

In effect, the adjustments become *inter*dependent—there is an interaction between alignments for different rivet sizes—since *all* must be correct to deliver even *one* rivet.

This system is undoubtedly usable, and doubtless performs a useful function, but the reliance upon multiple alignments for delivery of only a single rivet (except for the rivets in the furthest downstream turntable) makes the system either inordinately costly or extremely tedious to adjust and extremely temperamental. In this particular transfer-station design, it may be helpful to conceptualize these disadvantages as associated with the fact that the rivet delivery trajectory is a *compound motion*: (1) a rotary motion to line up the second diametral hole with the lengthwise hole in the block, then (2) a linear motion of the rivet itself through the first diametral hole of each other downstream turntable, to reach the delivery path at the end of the block.

Another perspective is that these disadvantages result from trying to transfer all the different rivet sizes from a common transfer station. As more and more rivet sizes are desired, for a particular complexity of workpiece and thus riveting procedure, the transfer station becomes longer and longer. Presumably, in a system of this type designed to handle sixty-four different rivet sizes, delivering just one rivet of just one size from the upstream turntables would require perfectly adjusting as many as sixty-five different alignment stops.

Another prior-art transfer station, attributed to a German manufacturer, reportedly makes use of a carousel to receive a large number of different rivet sizes—each in a separately movable transfer shuttle carried on the carousel. To deliver a rivet of any one of these sizes, first the carousel rotates to line up the corresponding shuttle with an actuator and/or a track, and then the shuttle is actuated forwardly along the track to the center of the carousel. When the shuttle reaches the center of the carousel, the rivet is dropped and/or blown out of the shuttle into a delivery path.

In this system successful transfer of any one rivet size requires accurate adjustment of the receiving position of each shuttle to align with the supply path from its corresponding rivet feeder bowl—or requires continuously attached flexible supply paths, whose downstream ends rotate with the carousel. The latter design choice poses problems of its own. In addition, successful transfer requires accurate adjustment of the delivery position of each shuttle to align with the common central delivery path. Unfortunately, these two adjustments are not the only ones required to transfer a rivet, since the carousel too must be made to line up the shuttle of interest with the actuator and/or track.

In principle the system could be provided with a guide that accepts the shuttle over a relatively wide range of positions, and funnels it into a progressively "tighter" trajectory to the center of the carousel. In practice, however, this type of guiding arrangement would pose operational problems of its own. Consequently the rotary stops of the carousel must be made quite precise. Rotary stops, however, by their intrinsic geometry cannot be configured as positive limit stops; they must be detents or the like.

Detents are notoriously subject to wear, inherent imprecision, and unreliability. They are also likely to be very fussy to adjust. Consequently this transfer-station design is inherently flawed by virtue of its dependence upon detents and/or a temperamental guide system.

In this system as well as the system previously discussed, it appears helpful to associate the system drawbacks with a *compound transfer motion*. The transfer motion in this system, in fact, is even more pronouncedly compound than that in the Gemcor system described above. In the carousel system, transfer of one rivet requires (1) a rotary motion to align a particular shuttle with the actuator/track, and (2) a rectilinear motion to move the shuttle into the center of the carousel. Considering only the transfer sequence, therefore, the faults in this type of system are clearly associated with the use of a compound transfer motion or transfer trajectory—as distinguished from a single-stage motion.

Furthermore, unless a flexible-tube supply system is used, the carousel must (3) rotate back to a resupply position to replace a rivet in the emptied shuttle, before another rivet of the same size can be transferred. Since it is commonplace to require transfer of several rivets in a row that are the same size, this last feature introduces a good deal of extra motion, leading to wear and breakdown.

The three motions required to transfer and resupply any one rivet size can also absorb significant amounts of extra time.

The use of compound transfer motions, at least in the two prior systems of which we have heard, appear to be related to the various drawbacks of both systems; it may be concluded that such motions are highly undesirable. It is also fair to draw the generalization that attempts to transfer rivets of a *large number of different sizes* give rise to transfer stations having a large number of individually actuable transfer devices, and that having a large number of individually actuable transfer devices tends to require compound transfer motions.

It may be objected that this line of reasoning appears to lead to limitation of the number of rivet sizes which can be transferred. In fact that is not so; this reasoning only leads to limitation of the number of sizes transferable in a *single* transfer station. We have found that the use of a single station to transfer a large number of rivet sizes is undesirable, and that discarding the requirement of using a single station not only eliminates compound motions and their deficiencies, but also introduce certain other important benefits.

(e) Automatic measurement—Prior commercial measuring systems have used linear potentiometers, mounted to generate singals related to measuring-probe position. Such potentiometers provide, in effect, a fixed reference zero.

In use such a potentiometer may be adjusted so that its reference-zero position occurs at the point where the probe bottoms out—that is, where the probe position corresponds to zero workpiece thickness. If the workpiece is rather thick, however, this type of adjustment produces rather small gradations in output signal (that is, small differences relative to the total signal) for significant gradations in thickness.

In particular, the differences between signals require to reflect functionally different rivet lengths may be very small. This type of system therefore severely tests the linearity of the potentiometer, *and* requires the monitoring electronics to respond precisely to small differences superimposed on relatively large signals—always an unfavorable operating condition, for any measuring system.

An alternative is to adjust the potentiometer so that its reference-zero position occurs at some higher probe position, perhaps corresponding to the average anticipated workpiece thickness or some value near to that. This alternative, unfortunately, requires the use of numerous different gauge blocks or otherwise calibrated offsets—one such offset close to each range of thicknesses to be encountered in operation. The result is to introduce yet another elaboration and complexity into a system whose operation should be as efficient and convenient as possible.

Yet these systems, to the extent of their application as discussed so far, while aggravating are not prohibitively inconvenient to operate. That very condition, however, arguably sets in when one considers the difficulty of making tool changes or even tool adjustments. Such procedures should be routine in almost any industrial riveting operation, but as already mentioned they require recalibration of the measuring system.

Such recalibration, using a linear potentiometer, entails manually shifting the entire potentiometer to reposition its zero point. This is an expensive annoyance in any case, but particularly when the riveter head is inaccessible or when the zero must be found using several separate gauge blocks or other offset calibration.

Using a helical potentiometer or "helipot" for these applications might be helpful in reducing the sensititivity to potentiometer nonlinearities, but the linearity problem in the electronics would persist.

Furthermore, even with the best of prior-art measurement systems, the range of workpiece thicknesses over which measurements may be taken is severely limited—specificially, it is limited to the length of longitudinal travel of the potentiometer wiper (whether linear or helical).

As already mentioned, one of the most significant limitations in prior-art measuring systems has been the custom of taking the measurement at some other location than the one in which a rivet is about to be installed. In some cases this causes substantial inaccuracy in the measurement, and in some systems the measurement at each point is actually made *after* installing a rivet there, so that the only possible corrective action is a fully manual replacement procedure later.

All of these inconveniences, costs, and delays of the prior-art rivet feeding systems are eliminated by our invention, which nevertheless is relatively simple and economical to construct and to use.

BRIEF SUMMARY OF THE PREFERRED EMBODIMENTS OF OUR INVENTION

With our invention, positive control of rivet orientation is provided at the junction point of plural supply paths with the delivery path to the riveting machine.

This positive control is accomplished by a novel modular transfer station, substantially improved and simplified relative to the prior art. The transfer station of our invention transfers one rivet of the required size from the appropriate supply path to the delivery path, on demand by a fully automatic measuring device. The transfer station thus completely eliminates the loss of orientation control at the point of convergence of prior-art track and tube manifolds.

Of equal importance, it does so with extreme reliability, because it does not resort to the compound motions, the detents, or the multiple-alignment rivet paths of the prior art. With the present invention, all transfer paths involve only short, rectilinear transfer strokes, and all rivet-path alignments are of the positive-stop type. Furthermore, in the simplest system (a system capable of dispensing four rivet sizes), successful feed of each rivet size relies only on *two* such alignments, *independent* of the alignments for the other rivet sizes.

Modularity of the transfer station facilitates immense flexibility in the configuring of delivery systems for making complicated rivet products. Complex products require correspondingly complex combinations of rivet materials, diameters, lengths, head sizes, etc. Some such rivet-feeding systems can use multiple injectors—each with its own respective transfer station—while others may use cascaded transfer stations.

Thus, as examples, a system for sixteen rivet sizes may use either (1) four transfer stations and four corresponding separate injectors—in which case, dispensing each size still relies on only two independent alignments—or (2) five transfer stations in a cascaded relationship. In the latter case only four alignments are required to successfully deliver each rivet size; of the four, two are common to each group of four sizes, and the other two are independent. (These figures may be compared with those for the earlier-mentioned Gemcor system, in which dispensing one rivet size requires as many as seventeen correct alignments.)

Positive control of orientation is also provided at all other points in the system, particularly including the escapements and injector, thereby rendering feasible the use of pneumatic-tube transport to the injector. This feature in turn permits limiting the amount of equipment that must be mounted in close proximity to the installing head of the riveter: only the measuring device and the injector need be so mounted, the rest of the system being locatable remote from the riveter head.

Consequently there is ample room at the riveting head for working on strongly contoured products—such as the aircraft nacelles mentioned earlier. Stated more generally, the area near the riveter is uncluttered for maximum operating convenience; while the entire feed system is completely accessible in another area for rivet resupply, preventive maintenance, and such adjustments as may be required when changing workpiece types.

Orientation at the escapement is controlled by a dual-blade mechanism that positively orients each rivet, both before and while dropping it into a pneumatic supply tube to the transfer station.

Orientation at the injector is controlled by a two-stage mechanism. This two-stage injector automatically checks each rivet—by receiving it in a contoured receiving pocket, and optically verifying engagement of the rivet with the pocket contours—before handing it off to the riveter head.

The injector first stage receives the rivet at a substantial angle to the vertical, so that the injector can be mounted close under the top of the riveting machine's installing head. The first stage then rotates the rivet to a vertical position. The injector second stage grips the positively oriented rivet, positively maintaining its orientation, while placing it in the fingers of the riveter's installing mechanism.

Another distinctive feature of our invention is measurement of workpiece thickness at the same hole into which the corresponding rivet will be inserted. The feeding system immediately effects delivery of the correct rivet to that very hole—thus eliminating estimation error based on prior-art assumptions as to regularity of thickness between nearby holes.

Key features of our invention are described above in essentially industrial language. They may also be viewed in more general terms, keyed to the language of the appended claims, as follows.

One embodiment of our invention is a system for feeding rivets to the installing head of a riveting machine, for the purpose of installing rivets that have various "rivet parameters"—such as various lengths, diameters, materials, and rivet-head geometries.

Such rivets are to be installed in a plurality of locations in an article under manufacture. The characteristics of the workpiece, and of the desired rivet installation, at these locations may be described by correspondingly various parameters—namely, workpiece thickness, desired hole diameter, and such additional factors as might influence choice of rivet material or head geometry. These additional factors might include, for instance, the materials and the intended useages or applications of the workpiece.

In this document, all the parameters just enumerated are called "location parameters," simply to distinguish them from the above-mentioned "rivet parameters." (The term "location parameters" thus is *not* meant to refer only to the parameters required to "locate" or position a hole, although these positioning or *locating* parameters are encompassed within the term "location parameters.")

The system provided by our invention for dealing with this task advantageously includes some means for automatically measuring the "location parameters"—or at least one of them, such as thickness in particular—for each one of the prospective rivet locations in turn. Workpiece thickness is one of the factors that should be considered in selecting hole diameter; this interrelationship illustrates that the various location parameters are not all independent. It will be apparent that hole diameter is also measurable automatically, though with somewhat more complication than thickness measurement; and that most of the other workpiece factors mentioned above may be quite difficult or impossible to measure automatically, using the word "measure" in its strictest sense.

Nevertheless, it is possible to provide automatic means for discriminating between workpiece materials and intended useages, by virtue of either actual measurements or the reading of coded indicia or other designations placed on the workpiece preparatory to riveting. Some relatively primitive implementations of this coding concept are in commercial use; examples are (1) the use of spray-painted dots and a laser-guided dot sensing and riveter-positioning mechanism—but with manually actuated riveting; (2) preprogrammed positioning mechanisms; and (3) edge-tracing positioning mechanisms.

More-advanced systems might make use of machine-readable indicia, similar to the familiar universal product code, for notifying the riveter of changes in any of the "location parameters" mentioned above. For the purpose of this document we mean to include all such automatic discriminating means to be encompassed within the definition of the word "measure."

A preferred embodiment of our invention also provides a plurality of storage containers. Each of these containers is adapted for storage of a multiplicity of rivets. It is intended that all the rivets stored in each container have a particular set of "rivet parameters" in common—so that the apparatus can draw upon the rivets in a particular container whenever a rivet with the corresponding rivet parameters is needed.

By testing we have found that our invention is extremely reliable. In fact it is so reliable that the major residual source of operational failure is the inadvertent inclusion of "out-of-specification" rivets in a storage container. Such "out-of-spec" rivets can jam in the workpiece hole, if they are too large in diameter; or can be loose in the workpiece hole, if they are too small in diameter or too long; or can fall out of the workpiece hole when the workpiece is inverted, if they are too short; or can jam anywhere along the supply and delivery paths and the associated equipments if they are of an entirely inappropriate rivet type or size.

Needless to say, such eventualities are rather rare, and in principle can be virtually eliminated by automatic on-site prescreening of all the rivets in the storage containers. Such automatic on-site prescreening may be conducted either at the point of entry to each storage container or at the point of discharge from each container to its escapement.

In practice, however, we have found that the incidence of such "bad" or "out-of-space" rivets is minimal, since manufacturers generally use automatic rivet "classifiers" in packaging rivets. Only on-site operator errors contribute measurably to such incidence, and these can be minimized by providing covers for the containers, and by operator vigilance.

Furthermore, with our novel system, the amount of time required to note and remove "out-of-spec" rivets after installation in the workpiece, or to clear the system of them if they jam en route, is very short. "Down time," when it does occur, is very brief.

Part of the reason for our short down time is that our invention renders the riveting-machine installing head very accessible, for observations and corrective maneuvers. Another part of the reason is that our invention renders it feasible to mount all the other operating parts of the system remote from the installing head, and thus likewise very accessible—for clearing "out-of-spec" rivets, as well as other procedures. Such rivets almost always can be removed from the feeding system in a matter of a very few minutes at most. In most cases a cursory visual inspection suffices to locate the problem rivet, though malfunction-location indicators are readily provided.

These factors obviate the need for automatic on-site prescreening.

A preferred embodiment of our invention also includes a plurality of removal devices. Each of these devices is associated with a respective one of the storage containers for removing rivets from its associated container. That is to say, each removal device is associated with one of the storage containers, and is provided for the purpose of removing rivets from that associated container.

Prior-art devices provided for this purpose have been mechanisms called "escapements," and our invention encompasses the use of such mechanical escapement-type devices as removal devices. In fact, as explained below, a preferred embodiment of our invention includes provision of a novel escapement-type mechanism that positively controls the orientation of each rivet as such rivet is removed from its storage container.

Nonetheless, we have used the general term "removal devices" because our invention also encompasses the use of conventional escapements, and furthermore encompasses the use of other, entirely different, devices for removing rivets from an associated storage container. Thus we define the term "removal devices" to encompass, for example, nonmechanical devices that move—or release—rivets electromagnetically, fluidically, or by other means that are not strictly "mechanical."

A preferred embodiment of our invention also includes at least one transfer station. The transfer station has a plurality of independently actuable transfer devices. Each of these transfer devices is associated with a respective one of the removal devices mentioned above, and when it is selected and actuated each transfer device receives rivets from its associated removal device, and automatically transfers such rivets into a delivery path. The transfer devices too may be mechanical, as in our currently preferred embodiment, but like the removal devices the transfer devices are not limited to mechanisms.

It is to be understood from the description to this point that each different transfer device of the plurality may be identified with a different set of such rivet parameters. In particular each transfer device is identified with a set of rivet parameters that corresponds to the rivet parameters of rivets received from the associated removal device (and *its* associated storage container).

A preferred embodiment of our invention also includes some means for automatically performing a selection process. These "automatic selection means," as we call them in this document, are responsive to the measuring means mentioned above.

The automatic selection means are provided for the purpose of determining and selecting a set of rivet parameters which corresponds to the measured location parameters, and for selecting a transfer device identified with that set of rivet parameters. The automatic selection means perform these functions for each one of the locations in turn.

A preferred embodiment of our invention also includes some means for automatically actuating the selected transfer devices in turn. These "automatic actuating means," as they are called here, are responsive to the selection means.

Finally, a preferred embodiment of our invention includes an injector for receiving rivets from the selected transfer device, via the delivery path, and for presenting these rivets—one at a time, in a controlled orientation—to the installing head of the riveting machine.

When all these features are provided in combination, one rivet, having "rivet parameters" selected by the selecting means as corresponding to the "location parameters" for each particular location, is delivered to the installing head for installation in that particular location.

Another perspective on our invention may be gained by considering another preferred embodiment. The features described below in connection with this other embodiment may be provided in combination with the features already described, or separately from them.

In this embodiment, automatic measuring means are mounted *in proximity* to the installing head of the riveter. These measuring means are provided for the purpose of measuring location parameters for each location, as previously described.

A plurality of storage containers is provided, mounted *remote* from such installing head. Each container is adapted for storage of a multiplicity of rivets having a particular set of rivet parameters in common, as previously described.

A plurality of removal devices is provided, each being associated with and mounted adjacent to a respective one of the storage containers. As described previously, each removal device removes rivets from its associated storage container. In the present embodiment, however, it is expressly understood that the removal devices perform this task with *positive control* of rivet orientation.

Also provided are automatic selection means, responsive to the measuring means, for determining and selecting a set of rivet parameters which corresponds to the measured location parameters, for each location in turn; and some means for defining a *pneumatic delivery* path. The delivery path terminates in close proximity to the installing head of the riveter. Also provided are some associated means for supplying pressurized gas to propel rivets along the delivery path.

Some means, which we call "transfer means" in this document, are also provided for receiving rivets from the removal devices, and for automatically transferring rivets having a selected set of rivet parameters into the pneumatic delivery path. The transfer means are mounted remote from the installing head, and are made responsive to the selection means. Both the receiving of rivets from the removal devices and the automatic transferring into the delivery path are accomplished with *positive control* of rivet orientation.

Finally, an injector is provided for receiving rivets from the delivery path—with *positive control* of rivet orientation—and for presenting them—one at a time, with *positive control* of orientation—to the installing head of the riveter. The injector is mounted in *close proximity* to the installing head.

This embodiment differs from that of the previous description in that (1) the transfer station does not necessarily have a plurality of independently actuable transfer devices, but (2) positive control of rivet orientation is explicitly provided at each point in the system, and (3) certain components are expressly to be positioned near, and others expressly remote from, the installing head of the riveter; and finally (4) the near and remote rivet-handling components are linked by a pneumatic delivery tube.

Thus (a) the description of *this* embodiment emphasizes one conceptualization of our invention as depending upon positive orientation control to make pneumatic delivery feasible, and then depending upon pneumatic delivery to effect all the space-efficient advantages previously enumerated; whereas (b) the *previous* description generally emphasizes a different conceptualization of our invention as depending upon a transfer station that uses only short, rectilinear transfer trajectories that are defined exclusively by alignment of positive stops—which as a general proposition are independent of one another as between different rivet sizes.

We consider each of these conceptualizations of our invention to be meaningful, and to describe a system that is new, useful and unobvious. It is meant to be clear that these conceptualizations may both be implemented together, in which case all of the advantages accruing from both conceptualizations will accrue together.

Yet other conceptualizations of our invention are presented below; these too may be implemented separately from each other, and from the above enumerated conceptualizations, or in various combinations and subcombinations to obtain some of the corresponding benefits:

(c) Our invention provides an novel improved "transfer station," which introduces the use of (i) exclusively short, rectilinear transfer trajectories, (ii) transfer motions delimited exclusively by alignment of positive stops, and (iii) in many or most cases, no more than two independent stop alignments for successful delivery of any one rivet size.

(d) Our invention provides a novel escapement mechanism, which achieves positive orientation control by (i) capturing each rivet between two ledges formed atop respective opposed dual blades; and by (ii) independent manipulation of the dual blades to drop the rivet into a delivery tube without any possibility of its tumbling.

(e) Our invention provides a novel injector mechanism, which achieves positive orientation control by (i) receiving each rivet in a contoured pocket, whose surfaces the rivet should engage and fill in certain specific ways if it is correctly oriented; and by (ii) optically monitoring the engagement and filling of the pocket by the rivet, and signalling to the rest of the system whether these relationships are in good order; and finally by (iii) if they are in good order, rotating the pocket (with the rivet) into position for pickup by a separate injector stage that hands off the rivet to the fingers of the installing head. Positive operational reliability is further enhanced by (iv) independent positive camming of both the pocket rotation and the linear shuttle operation.

(f) Our invention provides a novel workpiece-thickness measuring device, which makes use of a precision rack-and-pinion combination driving a precision encoder, to obtain a completely zero-shiftable, extremely high-accuracy sequence of signals that reflect only increments of motion from any arbitrary zero point. This device provides enormous operational flexibility in terms of tool changes and adjustments, by facilitating recalibration of the zero point automatically and/or at the touch of a button after any such tool change or adjustment.

(g) Our invention provides a novel riveting machine, the first riveting machine ever to be capable of high-speed, reliable automatic installation of rivets that are automatically selected in "real time" to accommodate a great variety of workpiece parameters. This novel riveting machine includes (i) a support for the workpiece; (ii) a work station including mechanisms which measure the workpiece and which install and "upset" the rivets—and where, if desired, each rivet hole can be automatically drilled, immediately before rivet installation; (iii) a mechanism for advancing the workpiece to bring each rivet location in turn into alignment with the measuring, drilling and upset station; and (iv) an automatic rivet feeding system as already described.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

1. System Operation Generally

Figure 1:
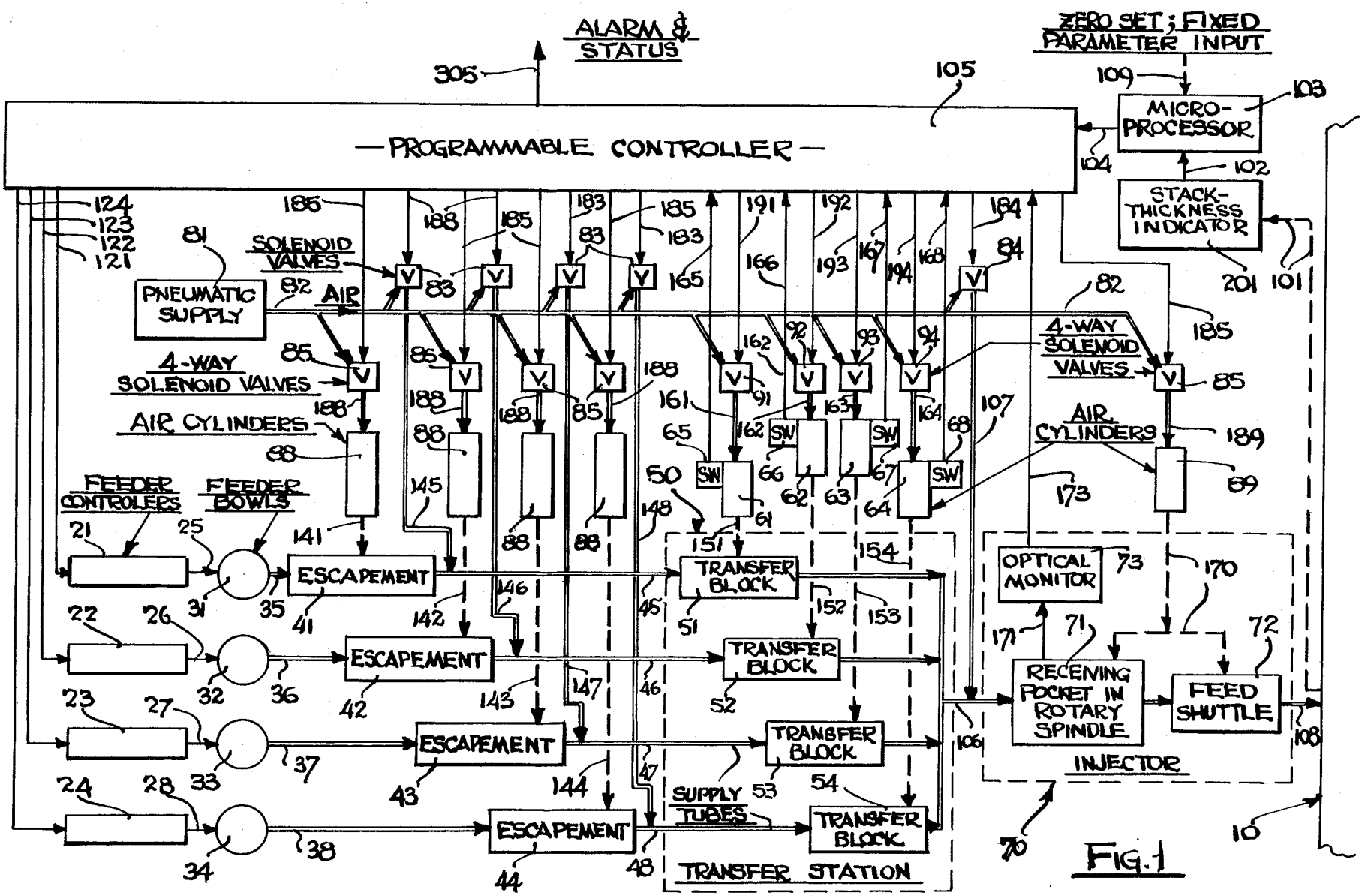
FIG. 1 is a schematic diagram of a rivet-feeding system in accordance with a preferred embodiment of our invention.

As shown in FIG. 1, a rivet-feeding system according to our invention generally has several rivet-storage containers such as conventional feeder bowls 31, 32, 33 and 34, each with its own conventional feeder controller 21, 22, 23 and 24. The controller of each bowl, when actuated by input power as at 121, 122, 123 and 124 respectively, provides a driving electrical signal 25, 26, 27, 28 which energizes a vibrator mechanism mounted to the bowl. The vibrators, in turn, cause the rivets stored in the bowls to line up and advance out of the bowls at discharge ports 35, 36, 37 and 38, into the respective escapements 41, 42, 43 and 44.

Each escapement, preferably of a novel type described in detail below, when actuated causes a rivet to move from the respective discharge port 35, 36, 37 or 38 into the respective supply tube 45, 46, 47 or 48. By virtue of the novel character of the escapements, rivets are moved into the supply tubes in the proper orientation, with extreme reliability.

Actuation of the escapements 41, 42, 43 and 44 is provided by mechanical drive members 141, 142, 143 and 144, respectively; these drive members may conveniently be the drive rods (or "piston rods") of respective air cylinders 88. The air cylinders 88, in turn, are energized by pneumatic signals 188, provided from a pneumatic supply 81 via air lines 82 and respective independent four-way solenoid valves 85. The four-way solenoid valves are controlled by electrical signals provided along respective independent signal lines 185.

The electrical drive signals 121, 122, 123, 124 to the feeder controllers, and the electrical signals 185 to the four-way solenoid valves as well, are provided by a programmable controller 105. The programmable controller 105 is made up of power-level output devices such as relay contacts, and signal-level input devices such as relay coils or even, in some instances if desired, solid-state signal-processing elements. The input devices are arranged to control the provision of power at the output devices—in response to the condition of other parts of the feeding system, as explained below.

Rivets moved into the supply tubes 45, 46, 47 and 48 are propelled along the tubes by pneumatic transport air streams, applied to the supply tubes by respective air lines 145, 146, 147 and 148. These air lines, in turn, are activated from the pneumatic supply 81 and air lines 82, through respective independent solenoid valves 83. The solenoid valves 83 are controlled by electrical signals along respective independent signal lines 183 from the programmable controller 105.

Rivets in the supply tubes 45, 46, 47, 48 are received and held in respective transfer blocks 51, 52, 53, 54 within the transfer station 50. The transfer blocks retain one rivet each, and are *independently movable.* When actuated each transfer block moves its retained rivet *directly* into a common delivery tube 106. In a later section of this description the mechanics of this operation are explained very specifically. (The word "directly" is particularly important here, since it might be supposed from the entirely schematic representation of FIG. 1 that there are junction points between the transfer blocks and the delivery tube 106; to the contrary, each transfer block places rivets directly into a unitary, junctionless delivery tube.)

The transfer blocks 51, 52, 53, 54 are independently impelled by mechanical links such as the respective drive rods 151, 152, 153, 154 of respective air cylinders 61, 62, 63, 64. These cylinders, in turn, are actuated by respective pneumatic signals 161, 162, 163, 164, which are derived from the pneumatic supply 81 and air lines 82, under control of respective four-way solenoid valves 91, 92, 93, 94. As in the case of the similar valves 85 that control the escapements, these valves 91, 92, 93, 94 are opened and closed independently by respective electrical signals 191, 192, 193, 194.

The positions of the transfer blocks relative to their respective delivery strokes are monitored by means of respective proximity switches 65, 66, 67, 68. These switches respond to the positions of the movable cores or pistons of the respective air cylinders 61, 62, 63, 64, providing a switch-closure signal to the programmable controller 105 along respective electrical signal lines 165, 166, 167, 168. The electrical signals indicate whether the transfer blocks have returned to their receiving positions—the positions in which they can receive resupply of rivets from the supply tubes 45, 46, 47, 48. Mechanically actuated switches might do as well, but maintenance factors and neatness militate in favor of magnetic proximity switches.

Once in the delivery tube 106, rivets are propelled very rapidly by transport air stream to the injector stage 70, which is mounted directly adjacent to the riveting machine and workpiece 10. The transport air is provided by the pneumatic supply 81 and air lines 82 under control of a solenoid valve 84. The solenoid valve 84 is actuated by an electrical control signal at 184 from the programmable controller. By virtue of the rapidity of rivet delivery within the delivery tube 106, the tube may be made quite long—fifty feet, for example, being not in the least unreasonable. Thus the transfer station 50 and all the upstream hardware (feeder controllers and bowls, escapements, supply tubes, and pneumatic supply), as well as the programmable controller 105, may be positioned remote from the riveter/workpiece 10.

Upon arrival at the injector 70, each rivet enters a contoured receiving pocket 71 in a rotary spindle. The receiving pocket is provided with an optical monitor 73, which obtains information as at 171 from pocket, indicating whether the rivet is of the correct general size and shape, and in particular whether it is correctly oriented. This information is provided as an electrical status signal at 173 to the programmable controller 105.

When the optical monitor 73 has signalled the controller 105 that the rivet is at least not an entirely out-of-specification rivet and is positioned correctly, the rotary spindle rotates and a feed shuttle 72 drives the rivet directly from the receiving pocket into the gripping fingers of the riveting machine. This motion is indicated schematically at 108 in FIG. 1.

Both the rotation of the spindle/pocket 71 and the operation of the feed shuttle 72 are effected by mechanical link 170, which may be the drive rod of an air cylinder 89. The air cylinder 89 is actuated by a pneumatic signal 189 from a four-way solenoid valve 85, which switches air from the pneumatic supply 81 and air line 82 under control of an electrical signal 185 from the controller 105.

The system also includes a stack-thickness indicator 201, which is a measuring device designated to engage the riveter/workpiece 10 directly, as symbolized at 101 in the drawing, to derive a sequence of electrical signals 102 related to the workpiece thickness. The signals 102 flow to a specially programmed solid-state electronic microprocessor 103. The microprocessor also accepts manual entry 109 of information from the operator of the system, particularly including a signal that identifies a particular condition of the physical engagement at 101 as corresponding to zero thickness.

Manual entry 109 also establishes the values of various parameters that are expected to be constant for the duration of a particular job (for example, for the completion of work on a particular workpiece). If desired these parameters may simply include the range of workpiece thicknesses that corresponds to the length of the rivets in each bowl.

We prefer, however, to treat those ranges as secondary parameters, and to program the microprocessor to calculate these ranges based upon primary parameters such as the rivet materials, rivet types, and rivet diameters that may be identified with each bowl 31, 32, 33, 34—and hence with each corresponding transfer block 51, 52, 53, 54. In some cases the primary parameters may also be treated as including form factors or the like that depend upon the workpiece materials and other characteristics. Using this preferred approach it is appropriate to enter these primary parameters by manual entry as at 109.

An alternative useful approach to entry of some of these primary parameters may be to encode them graphically, magnetically, or otherwise, onto the workpiece itself, and provide automatic means for reading and/or decoding them for use in the microprocessor 103. Yet another approach is to equip the apparatus to measure some of these parameters directly; of the several primary parameters the one most clearly amenable to such an approach is hole diameter. An application of hole-diameter measurement is discussed below.

In any event the microprocessor 103 derives and transmits to the programmable controller a control signal 104 which represents the result of a selection process. Part of the input information for this selection process, as has been explained, is the aggregate of "location parameters" for the particular hole location in the workpiece; and in effect the output or control signal 104 represents "rivet parameters."

This selection process thus may be perceived as selection of a rivet specification, in an abstract or arithmetical sense. In a more practical sense, however, it may instead be perceived as selection of a particular combination of feeder controller, feeder bowl, escapement, supply tube, and transfer block. It is fair to describe seeing the selection in terms of the hardware involved as "more practical" since it is the corresponding hardwired signal lines 185, 183, and 191 through 194 which the programmable controller 105 must selectively energize to deliver the appropriate rivet via delivery tube 106 and injector 70 to the work.

It is now possible to describe the sequence of operations which the system of FIG. 1 performs:

(A) When the system is turned on, the microprocessor 103 and the programmable controller 105 automatically sequence through a measurement-system recalibration procedure, with the workpiece removed from the throat of the riveter to provide a "reference" or "zero" reading to the electronics.

In principle the reference could be taken at the zero-thickness position of the measurement probe, and such a technique is quite feasible with some riveters. In practice, however, it is unfeasible for certain riveting equipment. This statement will now be explained.

Immediately above the workpiece at the point where rivets are installed, most riveters have a component known as a "pressure-foot bushing," which is hollow. (Drills typically advance downward through this bushing to create holes for the rivets. The shank ends of the rivets themselves typically protrude upward from the workpiece into this bushing before being "upset"; and a component known as the "bucking anvil" is later advanced downward through the same bushing to effect the "upset.")

In some riveting machines the workpiece-thickness measurement probe is aligned with the hollow center of the pressure-foot bushing. This configuration results in the measurement probe having no actual surface to engage, to establish a measurement "zero" reading.

In such systems, some object which *spans* the hollow center of the pressure-foot bushing must be placed between the bushing and the probe, to provide a surface for the probe to engage. The effective thickness of that object must be taken into account—that is, it must be added to the measured values. With automatic measurement systems such as ours, the numerical value of the offset must be entered for use in the microprocessor calculations. A calibrated gauge block may be used as the "object," but with our improved stack-thickness indicator it is *not* necessary to use a block whose thickness is close to that of the workpiece. If desired, the apparatus may be automated to emplace the gauge block as part of the recalibration sequence.

(B) When the feeding system is in a "ready" condition, the feeder bowls 31, 32, 33, 34 are all provided with rivets, and the respective escapements have all moved one rivet from each bowl through the corresponding supply tubes 45, 46, 47, 48 and into the corresponding transfer blocks 51, 52, 53, 54. Thus there is a rivet waiting in each transfer block.

(C) The first active step is for the riveting machine to advance the workpiece for measurement, as at 101, by the stack-thickness indicator 201.

(D) The measurement signals are converted essentially instantaneously by the microprocessor 103 into a selection signal 104.

(E) This signal is used within the programmable controller 105 to select a particular set of signal lines 185, 183, 191, 192, 193, 194 for actuation. Specifically, the controller 105 will select:

(1) one of the four escapement signal lines 185, *and*

(2) one of the four supply-tube-transport-air signal lines 183, *and*

(3) one transfer-block signal line, 191, 192, 193, or 194.

For purposes of discussion let it be supposed that the rivet parameters represented by the control signal 104 correspond to the rivets in the third feeder bowl 33. The selected signal lines in this case will be:

(1) the third feeder-controller signal line 123—to the feeder controller 23 that is associated with feeder bowl 33, and (2) the third one of the four escapement-actuating signal lines 85, and (3) the third transfer-block signal line 193.

Although these lines are at this point selected for actuation, they are not yet actually actuated (that is, not yet electrically energized).

(F) If the riveter is a type which drills rivet holes immediately before the rivet is installed, that step occurs next.

(G) Then the programmable controller *actuates* the transfer-block signal line 191, 192, 193, or 194 that was just selected, to activate a four-way solenoid valve.

Continuing the example introduced at paragraph (E) above, the programmable controller must energize the third transfer-block electrical control line 193, which leads to the corresponding four-way solenoid valve 93.

(H) The activated solenoid valve responds by admitting compressed air from the pneumatic supply 81, via air lines 82, to the corresponding control air line. That air line in turn leads to an air cylinder.

Further continuing the example, that air line is the third air-cylinder electrical control line 163, which is associated with the third transfer block's air cylinder 63.

(I) The air cylinder moves its drive piston forward, and the piston advances the corresponding transfer block to carry a waiting rivet in that block into alignment with the delivery tube 106.

In the continuing example, the air cylinder 63 forces its drive piston 153 forward, and the piston 153 physically moves the third transfer block 53—and the rivet that is waiting in that transfer block 53—into alignment with the common delivery tube 106.

(J) The rivet drops from the transfer block 53 into the delivery tube 106.

(K) Next, the programmable controller 105 energizes the electrical signal line 184 that corresponds to pneumatic delivery: this electrical signal line 184 opens the corresponding solenoid valve 84, admitting pneumatic transport air from the pneumatic source 81 and the air lines 82 into the upstream end of the delivery tube 106.

(L) When the rivet arrives in the receiving pocket 71 of the injector 70, the optical monitor 73 in the injector directs a signal (as at 173) to the programmable controller 105, indicating whether the rivet type and orientation are acceptable.

If not, the programmable controller generates an alarm as at 305, and halts the delivery sequence. It is to be appreciated that this will be a rare occurrence, provided that suitable rivets have been placed in the feeder bowls—and particularly in view of the fact that a rivet which reaches the injector has already successfully negotiated one of the escapements, one of the supply tubes, one of the transfer blocks, and the delivery tube.

If the rivet type and orientation are acceptable, however, the controller 105 deenergizes the pneumatic-delivery electrical control line 184, thereby closing the associated solenoid valve 84 and interrupting the pneumatic transport air flow to the delivery tube 106. The controller 105 also deenergizes the electrical control line (193 in the example) that corresponds to the selected transfer block (in the example, the third transfer block 53).

(M) In response the associated four-way solenoid valve reverses the pneumatic connections to the corresponding air cylinder (in the example, cylinder 63), forcing the drive rod and connected transfer block (in the example, rod 153 and the third transfer block 53) back to their original positions.

(N) When the air cylinder has returned to its original position, the attached proximity switch registers this fact in terms of a switch-closure signal to the programmable controller 105.

In the example these operations would involve the third air cylinder 63, its proximity switch 67, and the signal line 167 to the controller.

(O) The programmable controller then acts to resupply the transfer block—that is, in the example, to resupply the third transfer block 53 with another rivet from the feeder bowl 33. This resupply is accomplished by:

(1) briefly energizing the electrical drive-signal line 123 to the third feeder controller 23, so that the feeder controller supplies vibration power at 27 to the third feeder bowl 33 and the bowl vibrates rivets along the discharge path 37 to the escapement 43;

(2) briefly energizing that one of the electrical signal lines 185 which is associated with the third escapement 43, so that the corresponding one of the four-way solenoid valves 85 operates to admit compressed air at 188 from the pneumatic supply 81 and air line 82 to the third of the air cylinders 88, whereupon the corresponding drive rod 143 mechanically operates the third escapement 43 to drop a rivet into the third supply tube 47; and (3) briefly energizing that one of the electrical signal lines 183 that is associated with the third supply tube 47, actuating the corresponding one of the solenoid valves 83 to admit compressed air at 147 to that third supply tube 47.

The admitted air blows the rivet through the tube to resupply the third transfer block 53, and the cycle is complete.

(P) The feed system is now quiescent, waiting for the riveting machine to again advance the workpiece for measurement.

2. System Operation With Multiple Transfer Stations

As shown in FIG. 1 (and also FIGS. 2 through 5), I prefer to limit the number of feeder bowls supplying a transfer station to a rather small number. My preferred embodiment, for standard rivets, uses only four feeder bowls to supply a given transfer station. This preference arises primarily from the simplicity and uncluttered configuration of a four-transfer-block transfer station—as will be seen from the detailed mechanical description of the transfer station.

Additional elements of preference, however, arise from the flexibility which is achieved in system operation. Modular transfer stations with just four "channels" each can be used to assemble a system that delivers many different sizes and types of rivets. Such transfer stations can be interconnected in a variety of ways (two are discussed below) to satisfy a large number of very different operating constraints.

In addition, by making the transfer stations of modest complexity it becomes possible to readily supply one or more *extra* transfer stations with a system. An extra transfer station is very readily and quickly placed in service as a substitute for any transfer station that requires maintenance—whether preventive or corrective. Thus down time can be reduced to an absolute minimum.

Figure 2:
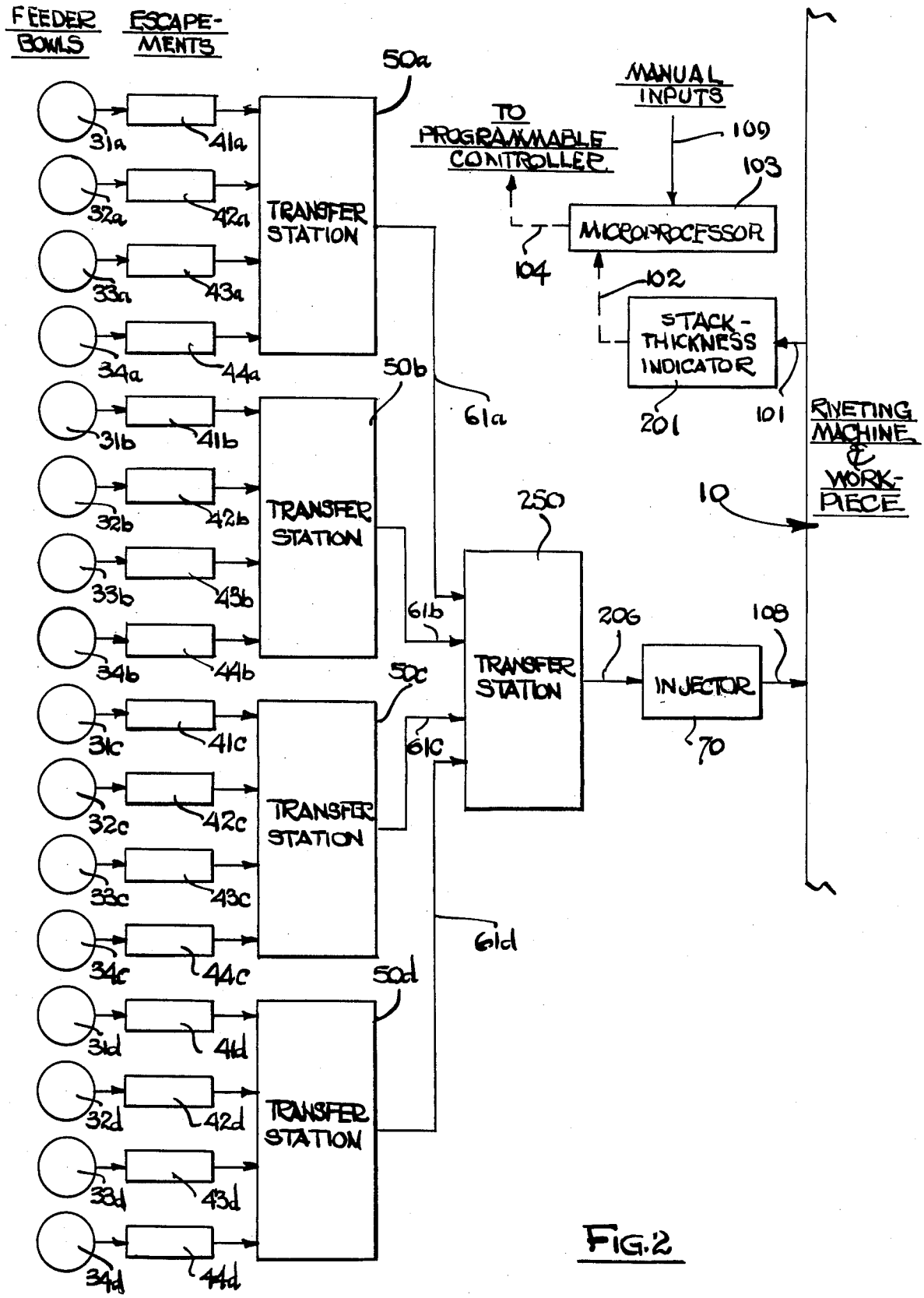
FIG. 2 is a simplified schematic diagram of a more complex rivet-feeding system that is another preferred embodiment of our invention.

In most or at least many practical cases, however, a complement of only four sets of rivet parameters is insufficient, and a greater number of transfer-station channels must somehow be provided. One way to accomplish this appears in FIG. 2—which is, in comparison to FIG. 1—a simplified drawing. FIG. 2 does not show the pneumatic and electrical subsystems, but rather shows only the rivet paths. FIG. 2 thus shows the lines corresponding to paths 35 through 38, 45 through 48, 106 and 108 of FIG. 1, plus some other rivet paths that are unique to the FIG. 2 system.

The left end of FIG. 2 shows the equivalent of four complete FIG. 1 supply-hardware sets. That is, there are four sets of four feeder bowls—31*a* through 34*a*, 31*b* through 34*b*, 31*c* through 34*c*, and 31*d* through 34*d*—or sixteen in all. Likewise FIGd. 2 shows four sets of escapements—41*a* through 44*a*, 41*b* through 44*b*, etc.—for a total of sixteen, each associated with one respective feeder bowl.

As in FIG. 1, each set of four bowl-and-escapement combinations feeds one transfer station. Here the first four feeder bowls and escapements—whose reference numerals in the drawing have the suffix "a"—all feed one transfer station 50*a*. Similarly, the next four bowls and escapements (with suffix "b") feed another transfer station 50*b*; the next four (with suffix "c") feed a third transfer station 50*c*; and the last four (with suffix "d") feed a fourth transfer station 50*d*. These four transfer stations have four corresponding output tubes or intermediate supply tubes 61*a*, 61*b*, 61*c* and 61*d*.

It is helpful now to bear in mind that the fundamental purpose of the transfer station is to eliminate the loss of orientation control of points of convergence of supply tubes with a common delivery tube. It will be appreciated, with this perspective, that reduction of sixteen supply tubes by use of four transfer stations to only four supply tubes 61*a*, 61*b*, 61*c* and 61*d* does not completely accomplish the fundamental purpose.

That purpose can, however, be completely accomplished by providing another transfer station 261 in cascaded series with the first four. The downstream station 261 in the cascade operates in essentially the same way as each of the others—that is, in the same way as the single transfer station 50 of FIG. 1—with just one major departure. After acceptable delivery to the receiving pocket in the injector 70 has been verified, the downstream cascaded transfer station 261 is *not* resupplied with another rivet. The reason for this departure is simply that the proper resupply rivet parameters cannot be determined until the next measurement has been made at 101 by the stack-thickness indicator 201, since there are four possible choices.

Thus, when the microprocessor 103 has signalled at 104 to the programmable controller (not shown in FIG. 2), that controller actuates both (1) an individual escapement—one of 41*a* through 44*d*—and its corresponding transfer block in one of the upstream transfer stations 50*a* through 50*d*; *and* (2) one of the transfer blocks in the downstream transfer station 261.

For instance, if the microprocessor control signal 104 corresponds to feeder bowl 33*b*, the programmable controller first actuates the third transfer block (not shown) within the second transfer station 50*b*. This transfer block then delivers a rivet (that has been waiting in that transfer station) to the second intermediate supply tube 61*b*; and turns on the transport air to the tube, to blow the rivet to the second transfer block (not shown) within the downstream transfer station 250. The programmable controller then actuates that second transfer block in the downstream transfer station 250, and turns on the transport air to the common delivery tube 206, to deliver the rivet via the delivery tube 206 to the injector 70.

Upon optical verification of rivet type and orientation, the programmable controller next cancels the transport air in the intermediate supply tube 61*b* and in the common delivery tube 206. The controller also reverses the air-cylinder pneumatic connections, to retract both the third transfer block within the second transfer station 50*b* and the second transfer block within the downstream transfer station 250.

The programmable controller then waits until it senses—by means of a proximity switch on the corresponding air cylinder—the return of the third transfer block within the second transfer station 50*b*. Upon receiving this block-return signal, the controller responds by vibrating the bowl 33*b* and then actuating the escapement 42*b*, to resupply a rivet to that same transfer block in station 50*b*. As already noted, however, there is no resupply to the downstream cascaded station 250.

The system is now quiescent, with a rivet waiting as before in each transfer block of each of the upstream four transfer stations 50*a* through 50*d*.

It will now be clear that with yet one additional level of cascade, four times the amount of supply hardware as shown in FIG. 2 can be funneled reliably into a single delivery tube and injector. That is to say, using four transfer stations such as station 250 feeding a single additional second-cascade transfer station, as many as sixty-four sets of rivet parameters can be accommodated on a simultaneous-on-line basis. This capability far exceeds the simultaneous-on-line requirements of any present riveting installation.

In most cases, as a matter of fact, the demand for delivery of rivets having *very greatly different diameters* would arise well before the demand for delivery of sixty-four different sets of parameters in general. The delivery of rivets with very greatly different diameters poses other complications, which are best met by a different system than that of FIG. 2. In particular, assuming rivets of greatly different diameters, adequate verification of rivet type and orientation is probably impractical with a single receiving pocket and a single optical monitor; and reliable delivery is probably impaired using only a single feed shuttle.

These complications could be addressed in the context of a FIG. 2 system by using multiple (possibly cascaded) receiving pockets, and/or adjustable receiving pockets and feed shuttles. My preference, however, is for separate injectors, each with its own receiving pocket and feed shuttle appropriate to the rivet diameter (or limited range of rivet diameters) that it will receive. A relatively small number of such injectors can be clustered around the gripping-finger mechanism of the riveting machine, arranged for alternative delivery from any one of the injectors to the gripping fingers.

The mechanical simplicity of each injector is maintained by this approach, and the benefits of modularity already outlined can also be maintained—particularly if the parts that are rivet-size-dependent are isolated and made replaceable, so that all the other injectors and injector parts can be interchangeable.

Figure 3:
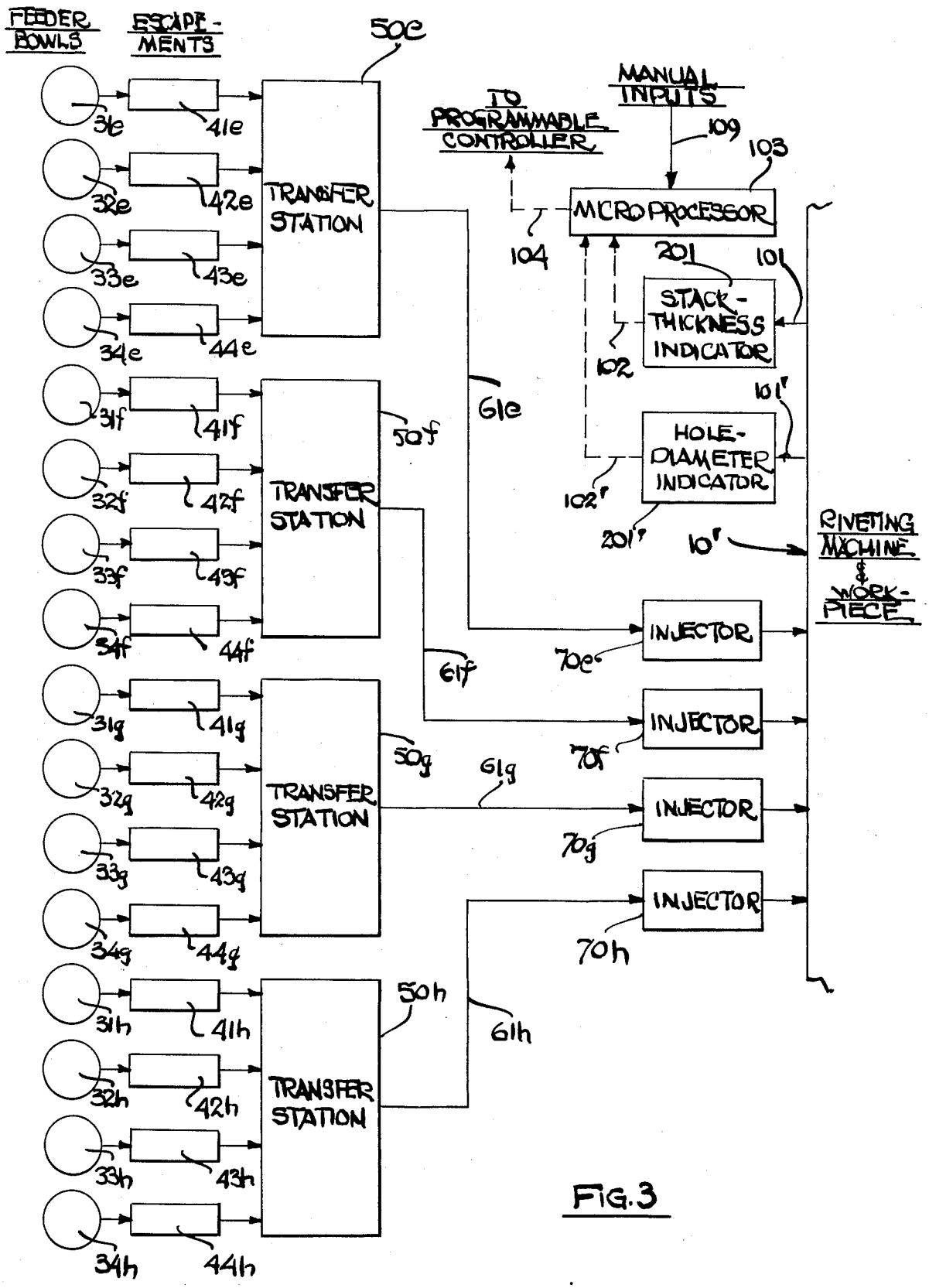
FIG. 3 is a schematic diagram similar to FIG. 2 but showing yet another preferred embodiment of our invention.

Such a system is illustrated schematically in FIG. 3. Here again there are four sets of feeder hardware—bowls 31*e* through 34, 31*f* through 34*f*, 31*g* through 34*g*, and 31*h* through 34*h*; plus corresponding escapements 41*e* through 44*e*, etc. The first four bowls and escapements (with suffix "e") feed the first transfer station 50*e*; the second four bowls and escapements (with suffix "f") feed the second station 50*f*; and so on.

The four transfer stations 50*e* through 50*h* in this system, however, do not feed a common cascaded transfer station as in FIG. 2 but rather feed respective independent injectors 70*e* through 70*h*, through respective pneumatic supply tubes 61*e* through 61*h*. The path convergence then occurs downstream of the injectors, at the point where the four injectors all hand off rivets (of different diameters) to the riveting machine.

It may be noticed that the system of FIG. 3 can, if preferred, be substituted for the system of FIG. 2 merely by using receiving pockets and shuttles adapted for the same rivet diameters, in all four injectors 70*e* through 70*h*. Such a system lacks some of the elegance of FIG. 2, and consumes slightly more valuable space at the riveter head—though the injectors are quite compact—but it has the advantage of being more quickly convertible into a system for handling multiple rivet diameters. Only the pockets and shuttles need be changed, to convert back and forth between workpieces requiring common-diameter rivet feed and workpieces requiring multiple-diameter rivet feed.

The discussion of the preceding paragraph simply illustrates the flexibility with which our invention can be made to accommodate various kinds of production schedules.

The hole-diameter indicator 201' of FIG. 3 would conventionally be used only for quality-control purposes, rather than for selection of a rivet size. The reason for this is that each hole is customarily drilled immediately before a rivet is installed in it, and by the same riveting machine that will install the rivet. Thus, in the conventional industrial approach, the hole size is part of the set of parameters selected in response to measurement of thickness (and determination of other workpiece characteristics), rather than being an independent variable.

It is in theory conceivable, however, that in some entirely novel systems the hole diameter could be somehow determined in advance, and the hole could be predrilled in a separate operational sequence and/or by a separate apparatus. In such systems the hole-diameter indicator 201' could be used to determine the hole diameter and to provide information as at 102' (FIG. 3) for use in rivet-parameter selection.

Yet another kind of variant is produced by combining the concepts shown in FIGS. 2 and 3. Just as one arbitrarily chosen example, it is straightforward to cascade rivets from three four-bowl-and-escapement sets through one downstream transfer station to one injector, while feeding rivets from a fourth set of four bowls and escapements to a second injector. Such an arrangement would be able to supply a dozen rivet sizes having one common, or nearly common, rivet diameter—and also four other rivet sizes having a different common, or nearly common, diameter.

From the discussion of the preceding paragraph it should be clear that the possibilities for adapting our invention to needed combinations of rivet parameters are virtually unlimited; and that by exploiting the amenability of the invention to modularity, such adaptations can be achieved with very little excess capacity.

3. The Transfer Station

Figure 4:
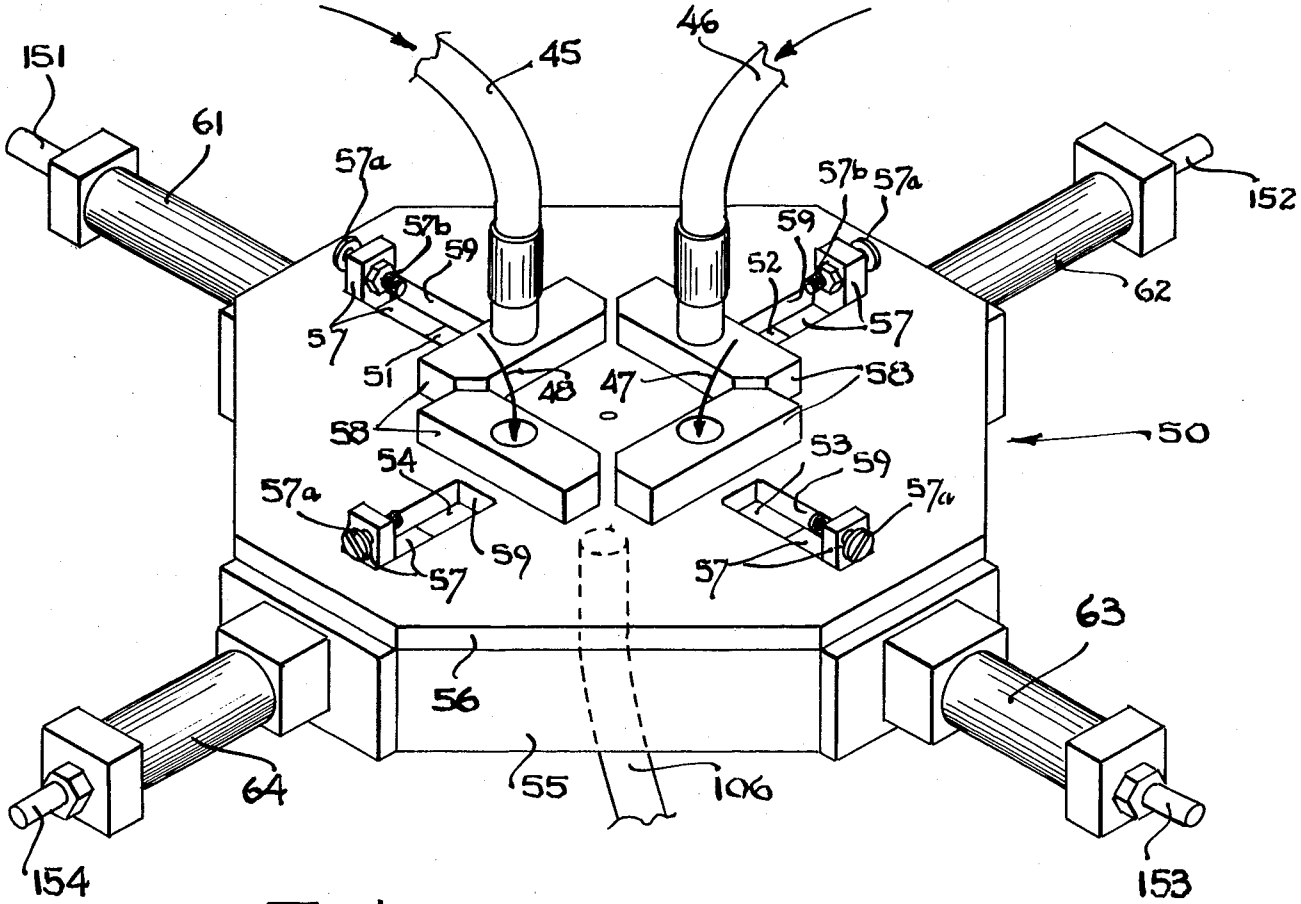
FIG. 4 is an isometric view of a key component, called a "transfer station," that forms part of the preferred embodiments shown in FIGS. 1 through 3 and is also itself a preferred embodiment of our invention.

As shown in FIG. 4, our preferred embodiment of our transfer station invention is a mechanical apparatus having a base 55 and a cover 56, and attachment points for four incoming or "supply" tubes 45, 46, 47 and 48 (the last two of these being shown only symbolically, for clarity of the other features in the drawing) and an outgoing "delivery" tube 106. (It may be noted, as an aid to understanding the transfer station in the context of the complete system, that all the reference numerals in FIG. 4 are consistent with those used in FIG. 1, and the terminology in this discussion likewise is consistent with that used in the discussion of that drawing.)

The four attachment points for the supply tubes include four respective adapter blocks 58; as will be seen these adapter blocks serve a dual function. The transfer station also has attached air cylinders 61, 62, 63 and 64 associated with the four supply tubes, respectively, each air cylinder having a respective drive rod or piston rod 151, 152, 153 and 154.

Movably mounted within the transfer station 50 for exclusively rectilinear motion are four transfer blocks 51, 52, 53 and 54, which are partially visible in FIG. 4, even with the cover 56 in place, by virtue of the four respective slots 59 in the cover 56.

Fixed to the four transfer blocks 51, 52, 53 and 54, for motion with the respective blocks, and partially extending upward through the slots 59, are four respective stop tabs 57. Threaded through each of these stop tabs, near the top, is a respective hardened-steel stop screw 57*a*, carrying a respective lock-nut 57*b*.

Each stop screw 57*a* strikes the respective adapter block 58 to define the forward end of the stroke of the corresponding transfer block. The stop screws 57*a* must be adjusted so that at the forward end of the stroke of each block the rivet being transferred aligns exactly with the delivery tube 106.

We have found that an alignment to plus-or-minus one thousandth of an inch (±0.001 inch) is desirable for reliable operation, and is readily obtainable with care in adjustment of the stop screws 57*a*, assuming proper selection of materials and threads for the screws 57*a*, adapter blocks 58, and stop tabs 57. In particular, the stop screws 57*a*, and the lock-nuts 57*b* and the threaded holes through the stop tabs 57, are all provided with fine threads, so that the necessary alignment accuracy can be readily achieved. Hardened materials are used to minimize adjustment drift though wear.

Proper alignment can be verified by means of an insertable circular gauge rod, which slips readily from each transfer block into the delivery tube 106 when the corresponding stop screw 57*a* is properly adjusted and the corresponding air cylinder is actuated to fully advance the transfer block.

In our preferred embodiments the total clearance between each rivet head and the interior surface of the delivery tube 106 is fifteen thousandths of an inch (0.015 inch).

Similar alignment provisions must be made for resupply of the transfer blocks with rivets from the supply tubes 45, 46, 47 and 48. This alignment can be effected using internal stops (not shown) within the respective air cylinders 61, 62, 63 and 64.

Figures 5, 6:
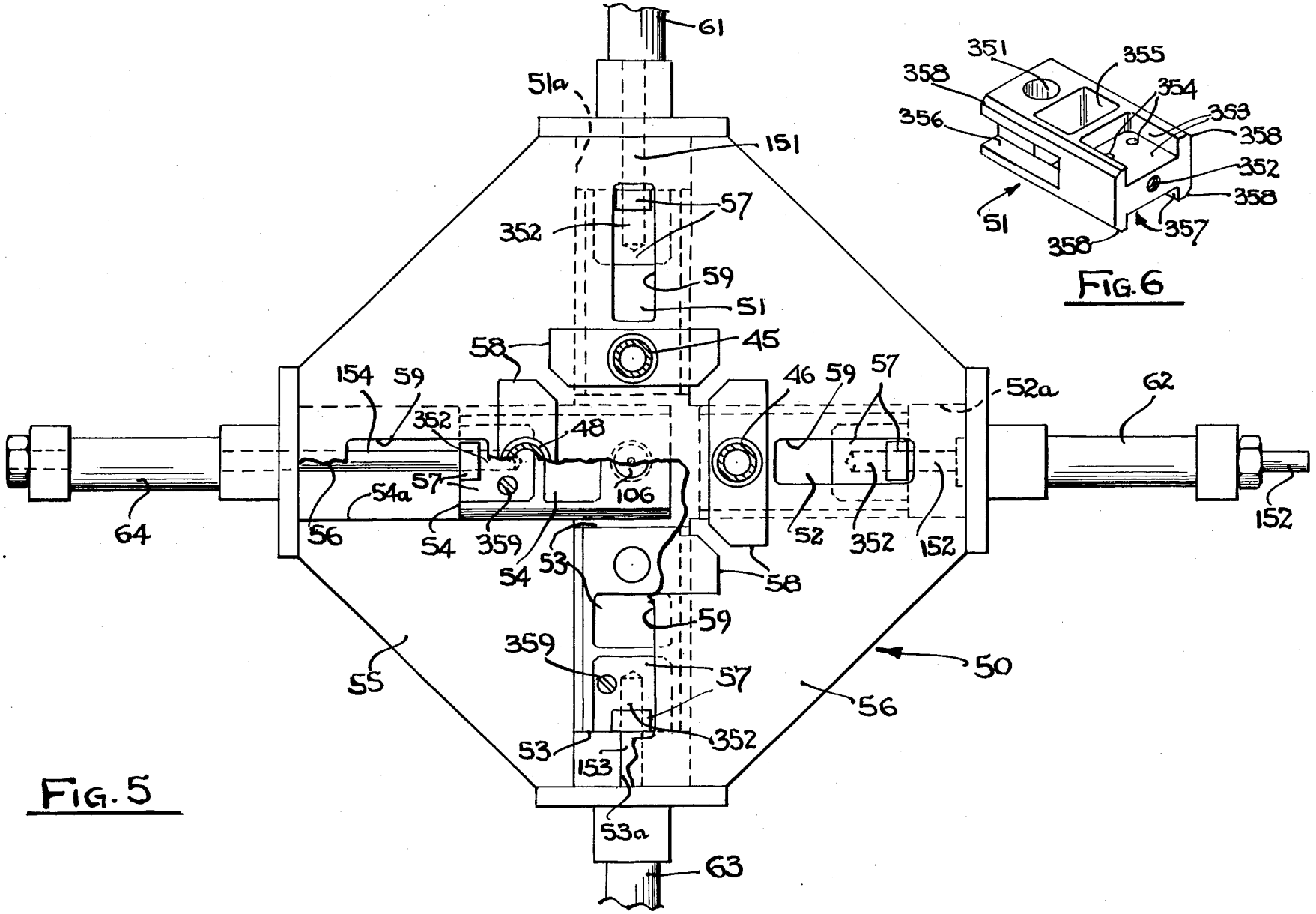
FIG. 5 is a plan view, partly broken away, of the transfer station of FIG. 4.
FIG. 6 is an isometric view of a key subcomponent, called a "transfer block," that forms part of the transfer station shown in FIGS. 4 and 5.

The internal construction of the transfer station 50 is shown more clearly in FIG. 5; and that of the transfer block 51 (and its identical copies 52, 53 and 54), in FIG. 6. Machined into the base 55 of the transfer station are four rectilinear tracks or ways 51*a*, 52*a*, 53*a* and 54*a*, in which the four respective transfer blocks 51, 52, 53 and 54 slide smoothly, respectively parallel to the lines of motion of the drive rods 151, 152, 153 and 154 of the respective air cylinders 61, 62, 63 and 64.

No rotary motion of any of the transfer blocks is provided, and all stop positions are positive stops; hence no detent-type stops are involved.

The drive rods 151, 152, 153 and 154 are screwed very securely into mating holes 352 (FIG. 6) at the outboard ends of the transfer blocks. (To show this more clearly, the stop screws 57*a* and lock-nuts 57*b* of FIG. 4 are omitted from FIG. 6.) A rivet-carrying hole 351 (FIG. 6) is drilled entirely through each transfer block, such as 51. The inside diameter of the rivet-carrying hole 351 matches those of the supply and delivery tubes 45, 46, 47, 48 and 106.

When a particular transfer block is in its fully retracted or outboard position (as is the case with blocks 51, 52, 53 and 54 of FIG. 5), a rivet arriving in the corresponding supply tube drops through the corresponding adapter block and the cover 56 into the rivet-carrying hole 351 in the transfer block. When that transfer block is then advanced by its corresponding air cylinder and drive rod, the rivet is carried forward within the rivet-carrying hole (sliding along the machined bottom surface of the corresponding track 51*a*, 52*a*, 53*a* or 54*a*), into alignment with the delivery tube 106, and drops through a hole in the base 55 and into the delivery tube 106.

In this way the tracks, transfer blocks, stop screws, adapter blocks, and air-cylinder internal stop mechanisms together define an exclusively rectilinear trajectory for each rivet, from points just below the ends of the respective supply tubes 45, 46, 47 and 48 radially inward (relative to the base 55) to the point just above the inlet of the delivery tube 106.

With respect to the transverse dimension, the trajectories are defined by the tracks; and with respect to longitudinal limits the trajectories are defined by the two positive stops provided respectively by (1) the stop screws and adapter blocks and (2) the air-cylinder internal stop mechanisms. Except in cascaded systems, delivery of each rivet size depends only upon alignment of these two respective positive stops.

Even in cascaded systems the number of additional alignments required to successfully discharge any one rivet size is limited to two alignments per downstream cascading stage—which is to say, two additional alignments *per factor of four* in the number of rivet sizes handled. This statement may perhaps be better understood by reference to FIG. 2.

The upper outboard portion of each transfer block is recessed as at 353 (FIG. 6), to accept the corresponding stop tab 57*a* (FIGS. 4 and 5), which is secured within the recess by means of screws 359. These screws 359 pass through clearance holes in the stop tab 57*a* and are threaded into tapped holes 354 at the bottom of the recess 353.

The four longitudinal corner edges of each transfer block are advantageously beveled as at 358 (FIG. 6), for smoothest operation. Other portions of each transfer block that are not structurally necessary are milled away, as at 355, 356 and 357 (FIG. 6), to minimize the inertia and consequently the transit time of the transfer block.

4. The Escapements

Figures 7, 10:
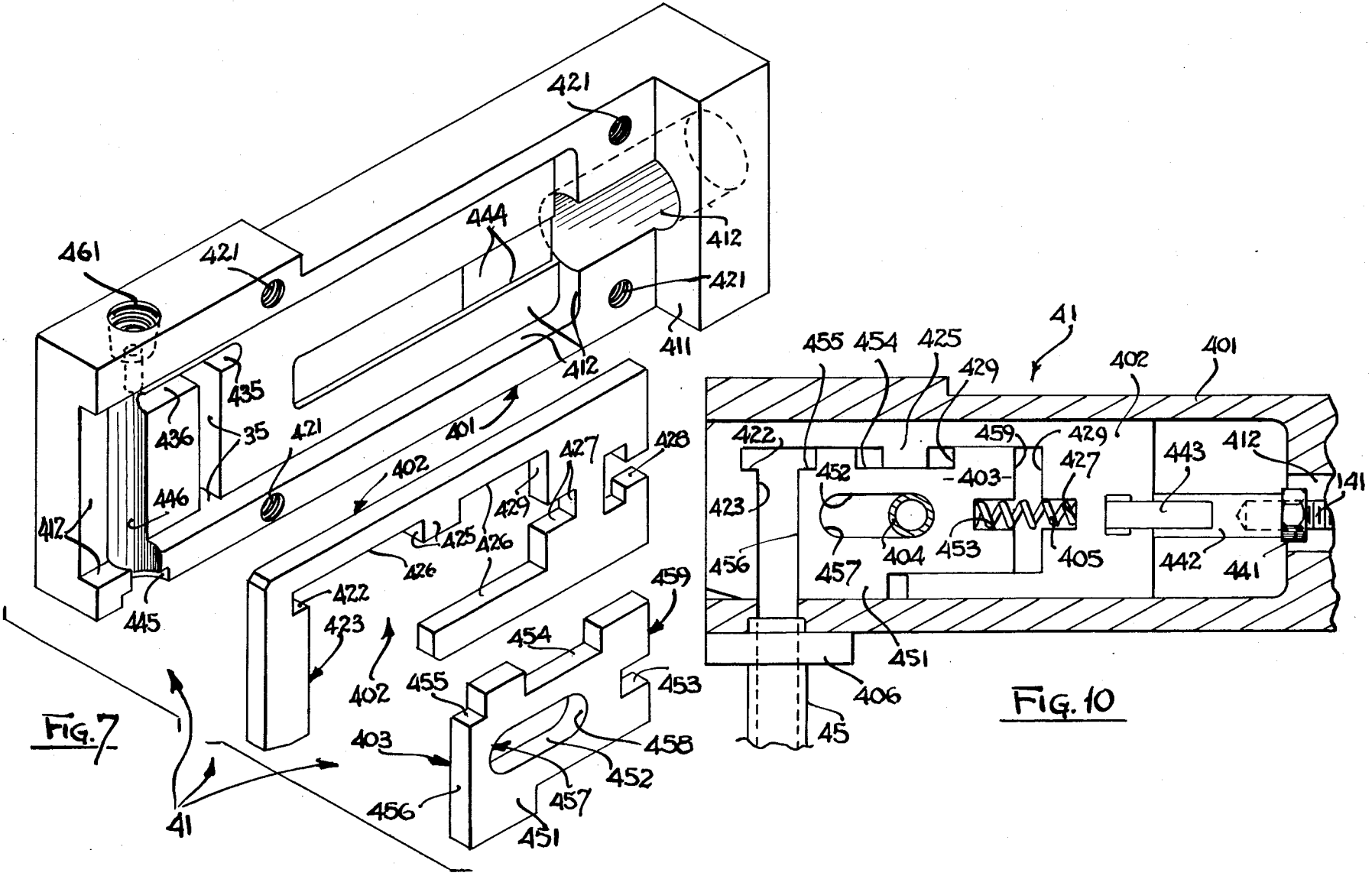
FIG. 7 is an exploded perspective view of portions of an escapement mechanism compatible with the feeding systems of FIGS. 1 through 3, and with the transfer station and blocks of FIGS. 4 through 6.
FIG. 10 is a similar elevation of the same escapement but showing it in condition to supply rivets to a supply tube.
Figure 8:
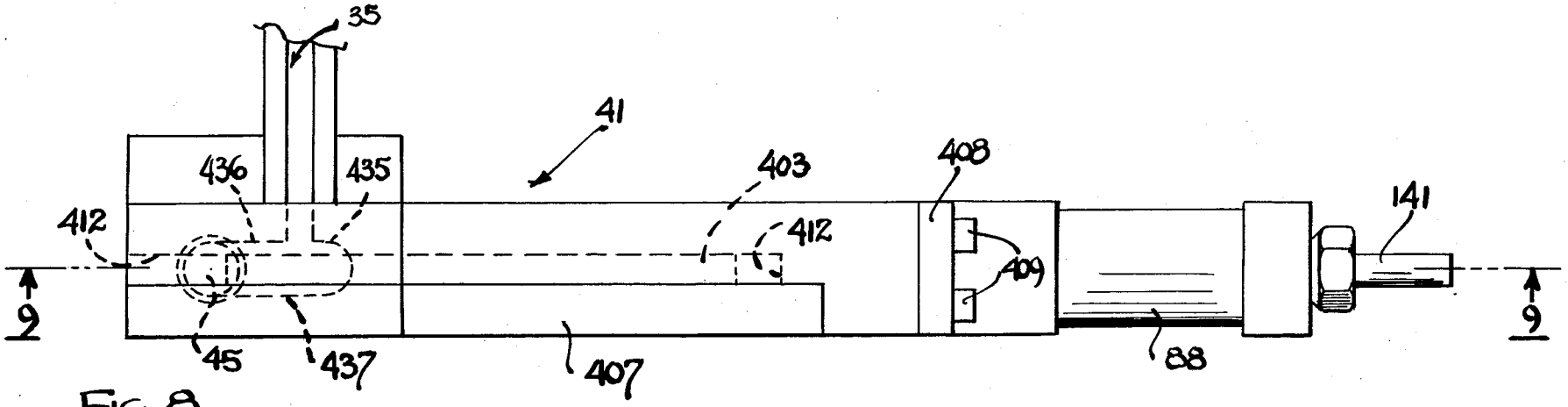
FIG. 8 is a plan view, with some internal parts shown in dashed line, of the escapement mechanism of FIG. 7.

As shown in FIG. 7, each escapement mechanism has three key parts—a panel 401, a leading blade 402, and a trailing blade 403. The panel 401 is hollowed out to form the end walls, top, bottom, and one side wall of a cavity 412. The other (opposing) side wall of the cavity is provided by a cover 407 (FIG. 8) that is adapted for mounting to the panel by means of screws (not illustrated) which thread into tapped holes 421.

Communicating with the cavity 412 near the left end of the drawing is a rectangular port 35, passing entirely through the panel 401. The port 35 (which also appears in FIG. 1) is aligned with the discharge point from a rivet-storage device, such as the feeder bowls 31 through 34 of FIG. 1. Also communicating with the cavity 412 at the left end of the drawing is a cylindrical subcavity 446—whose cylindrical shape is completed by a portion cut from the opposing wall of the cover 407.

The subcavity 446, in turn, communicates with a counterbore 445 which is adapted to receive the inlet end of a supply tube 45 (FIGS. 8 through 10, and FIG. 1). The tube 45 is held in place by an adapter block 406 which is secured to the underside of the panel 401 and cover 407.

Thus the port 35 and subcavity 446 provide inlet and outlet apertures, respectively, by which the escapement receives and supplies rivets.

The panel 401 also has a transverse enlargement 411, at the right end of the drawing, and the panel has a cylindrical access hole 412 which passes through part of the panel proper and entirely through the enlargement 411. This access hole 412 is provided for passage of the drive rod 141 (FIGS. 8 through 10, and FIG. 1) of an air cylinder 88 (FIGS. 8 and 9), which actuates the escapement mechanism.

Figure 9:
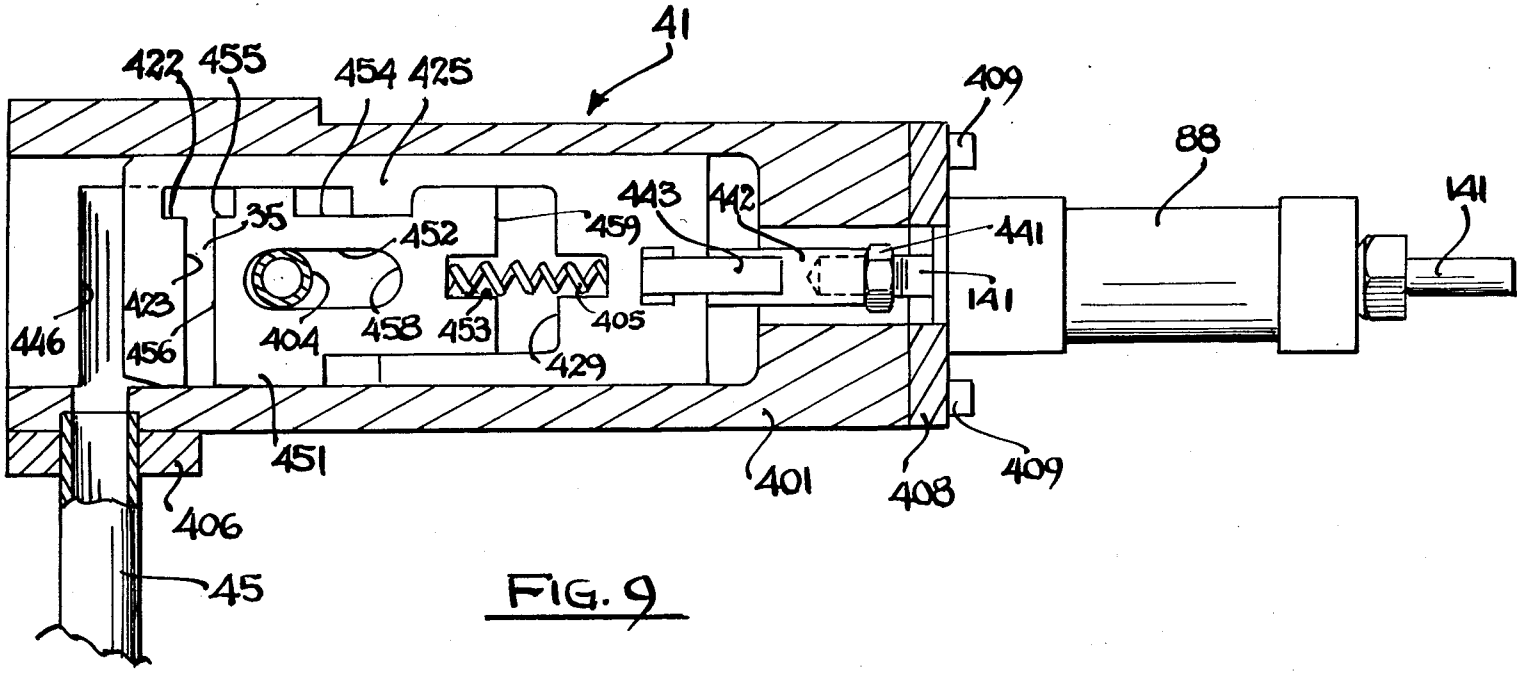
FIG. 9 is a side elevation, partly in section, of the same escapement mechanism, taken along the line 9—9 of FIG. 8 and showing the escapement in condition to accept rivets from a feeder bowl.

The cavity 412 is configured to accept the forward blade 402, which slides smoothly within the cavity parallel to the line of motion of the drive rod 141. The forward blade, in turn, is cut away to form a free internal space 426, within which smoothly slides the trailing blade 403—as illustrated in FIGS. 9 and 10. The sliding motion of the blades relative to the panel and relative to each other will be described in detail.

Cut into the wall of the cavity 412, paralleling the length of the panel, is an extended shallow groove 444 which accommodates a spring 405 and a drive link 443; a complementary groove (not shown) is provided in the opposing interior wall of the cover 407. The drive link, in combination with another linking member 442, interconnects the air-cylinder drive rod 141 with the rearward edge of the leading blade 402; and the spring 405 biases the trailing blade 403 forwardly relative to the leading blade 402—that is, biases the two blades together.

Another, shorter, groove 435–436 is also cut into the wall of the cavity 412, paralleling the length of the panel—with a complementary portion 437 cut into the wall of the cover 407. The very short rightward portion 435 of this groove, as well as the very short rightward end of the leftward portion 436, passes entirely through the panel 401 in communication with the rectangular entrance port 35. Thus the extrance port considered in its entirety is actually "T"-shaped, matching the general shape of each rivet. Rivets accordingly can enter the escapement only in a controlled orientation, the heads passable only through the upper, horizontal part of the "T"-shaped port, and the shanks passable through the lower, vertical part of the "T"-shaped port.

Furthermore, once inside the cavity the rivets are received in a likewise orientation-controlling receiving aperture, that is aligned with the "T"-shaped port and thus with the discharge point of the storage device. This receiving aperture is defined, as illustrated in FIG. 9, by the blade edges 423 and 456 of the leading and trailing blades 402 and 403 respectively. The leading blade 402 also has a ledge 422, directly at the top of the leading blade edge 423; and the trailing blade 403 has a corresponding ledge 455 directly above the trailing blade edge 456. The ledges are formed by cut-away configurations of the blades 402 and 403, respectively.

When the blades 402 and 403 are positioned as shown in FIG. 9, their respective edges 423 and 456 are aligned with the sides of the rectangular entry port 35—that is, the bottom of the "T"—and the ledges 422 and 455 are aligned with the grooves 435 and 436—that is, the top of the "T". The blade edges 423 and 456 and the ledges 422 and 455 thus form a very nearly exact continuation of the "T"-shaped entry port, so that rivets entering in a controlled orientation (as already described) through that port continue to be in a controlled orientation within the escapement.

The proper alignment of the blade edges 423 and 456 with the rectangular entry port 35 is essential to proper acceptance of each rivet, and is ensured as follows. The trailing blade 403, as already mentioned, slides within the open internal space 426 in the leading blade 402. The outer, leading blade 402, however, has a depending stop 425 in the upper edge of its internal space 426; and the inner, trailing blade 403 has a mating slot 404–454 cut in its upper edge.

When the inner, trailing blade 403 is advanced fully forward (leftward, in the drawings) so that the rearward edge 429 of its slot 454–429 engages the stop 425 of the outer, leading blade 402, the spacing between the blade edges 423 and 456 has exactly the desired value for accepting and transporting rivets. In other words, the distance between the blade edges 423 and 456 is defined by the dimensions and relative placement of the slot 454–429 and the stop 425, in relation to the distances (1) from the stop 425 to the leading blade edge 423, and (2) from the slot rearward surface 429 to the trailing blade edge 456. This condition is obtained by allowing the spring 405 to expand, driving the rearward edge 459 of the trailing blade 403 forward, away from the forward internal edge 429 of the leading blade 402—until the rearward surface 429 of the slot 454–429 in the trailing blade 403 engages the stop 425 of the leading blade 402.

Now the entire two-part blade assemblage 402–403 forms a moving "T"-shaped slot 423–456, defined by the blade edges 423 and 456 and the ledges 422 and 455. The width of the slot—that is to say, the interblade distance—is strictly controlled. This "T"-shaped slot is movable longitudinally relative to the panel 401, by moving the two-part blade assemblage 402–403 longitudinally as a unit. The blade assemblage 402–403 is operable in this direction under the influence of air cylinder 88, whose drive rod 141 is secured by two intermediate linking members 442 and 443 to the rearward section of the leading blade 402. In particular, the rightward (as drawn) end of the first link 442 is tapped to receive the threaded end of the drive rod 141.

The rearward motion of the drive rod 141 relative to the air cylinder 88 is limited by an adjustable internal stop within the air cylinder. When the drive rod 141 is fully rearward against this stop, the position of the movable slot between blade edges 423 and 456 is dependent upon the distance by which the threaded end of the drive rod 141 is screwed into the tapped end of the first link 442. That distance is to be adjusted as required to satisfy another condition, which will be described shortly; for the present, however, it may be taken as fixed.

For present purpose, therefore, the system is adjusted—with the drive rod retracted to its fully rearward position—by adjusting the internal stop of the air cylinder 88 to align the movable "T"-shaped slot with the entry port 35. This is the condition illustrated in FIG. 9.

Thus each rivet is properly accepted between the blade edges 423 and 456. When the rivet is to be supplied to the transfer station, the air-cylinder drive rod 141 moves the blades 402 and 403 forward in such a way that the blade edges move the rivet to a point directly above the supply tube 45.

It is equally important that for this supply part of the operation the blade edges align correctly with the corresponding internal surfaces of the tube 45. To accomplish this, the trailing blade is provided with an oblong slot 452, and a mating, longitudinally adjustable stop 404 is secured to the panel 401. While the leading blade 402 continues to advance under the influence of the drive rod 141, the trailing blade is first stopped by engagement of the rearward surface 458 of the slot 452 with the adjustable stop 404.

That adjustable stop 404 is adjusted longitudinally so that—with the trailing blade 403 hard against the stop—the trailing blade edge 456 is aligned with that interior surface of the supply tube 45 which is first encountered. That is to say, the trailing blade edge 456 is lined up with the supply-tube surface which is furthest rightward (as illustrated here).

The leading blade edge 423 is independently adjusted, by moving the drive rod 141 of the air cylinder 88 fully forward against the fixed internal stop of the air cylinder, and then rotating the drive rod 141 to screw it in or out of the tapped hole in the rearward link 442, as required to align the leading blade edge 423 with that internal surface of the supply tube 45 which is last traversed. In other words, the drive rod is rotated so as to line up the leading blade edge 423 with the leftward (as drawn) internal surface of the supply tube. The rearward link stands a fixed distance from the leading blade edge 423, so this adjustment fixes the forward position of the leading blade edge 423, at the forward end of the air-cylinder stroke. The adjustment is then cinched down by tightening the locknut 441 against the rearward link 442.

5. The Injector

As shown in FIGS. 11 through 16, the injector 70 has a body that consists of a split case 501 and 502, together with a forward case section 503, and a number of attachments and moving parts.

Figures 11, 11A, 11B:
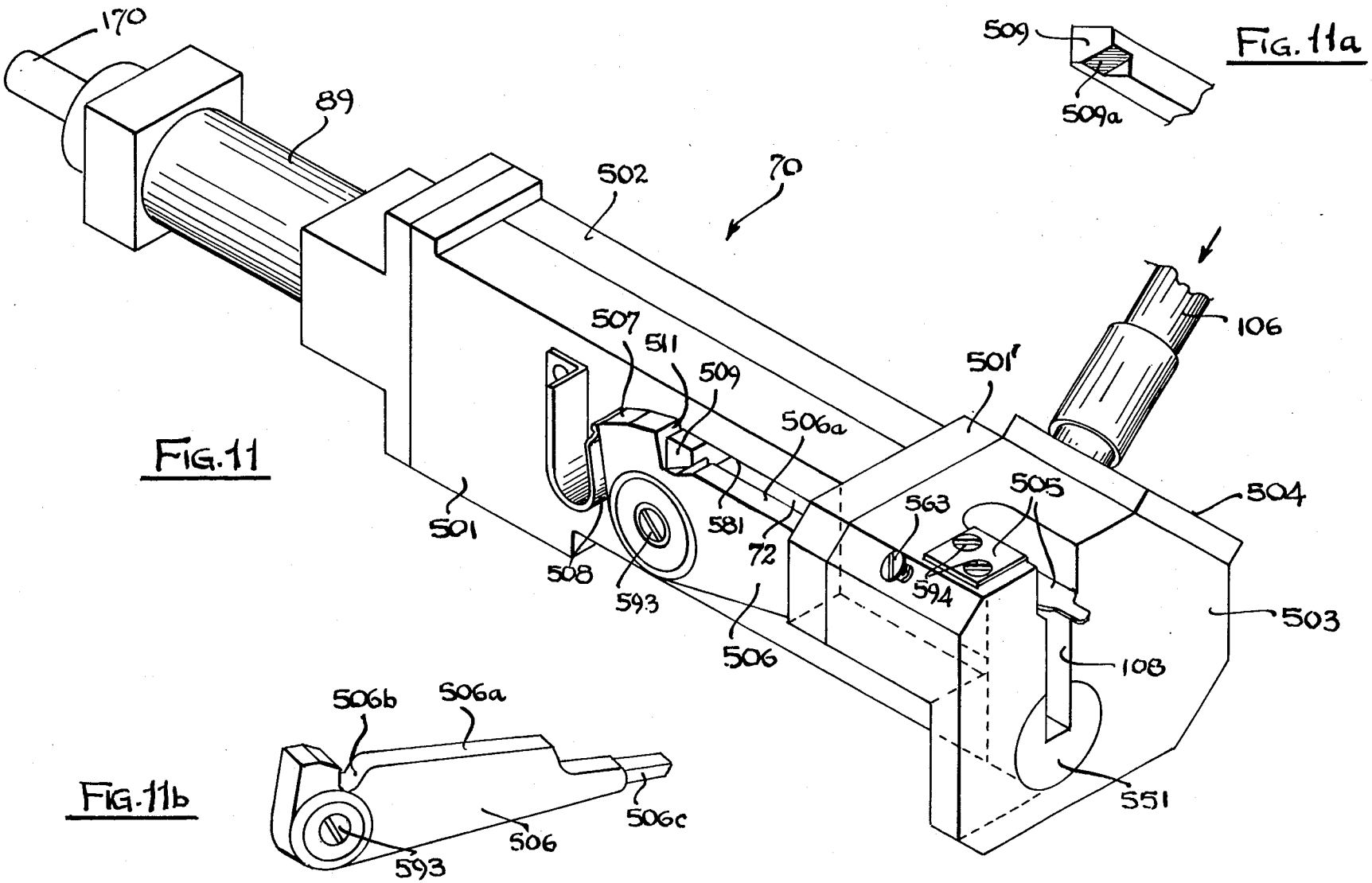
FIG. 11 is a perspective view of an injector that is compatible with the systems and other components of the earlier drawings.
FIG. 11*a* is another, clearer, perspective view of a small part—an actuating clevis and cam driver—that appears in FIG. 11.
FIG. 11*b* similarly is a clearer perspective view of another part—a lever and cam—that also appears in FIG. 11.
Figure 13:
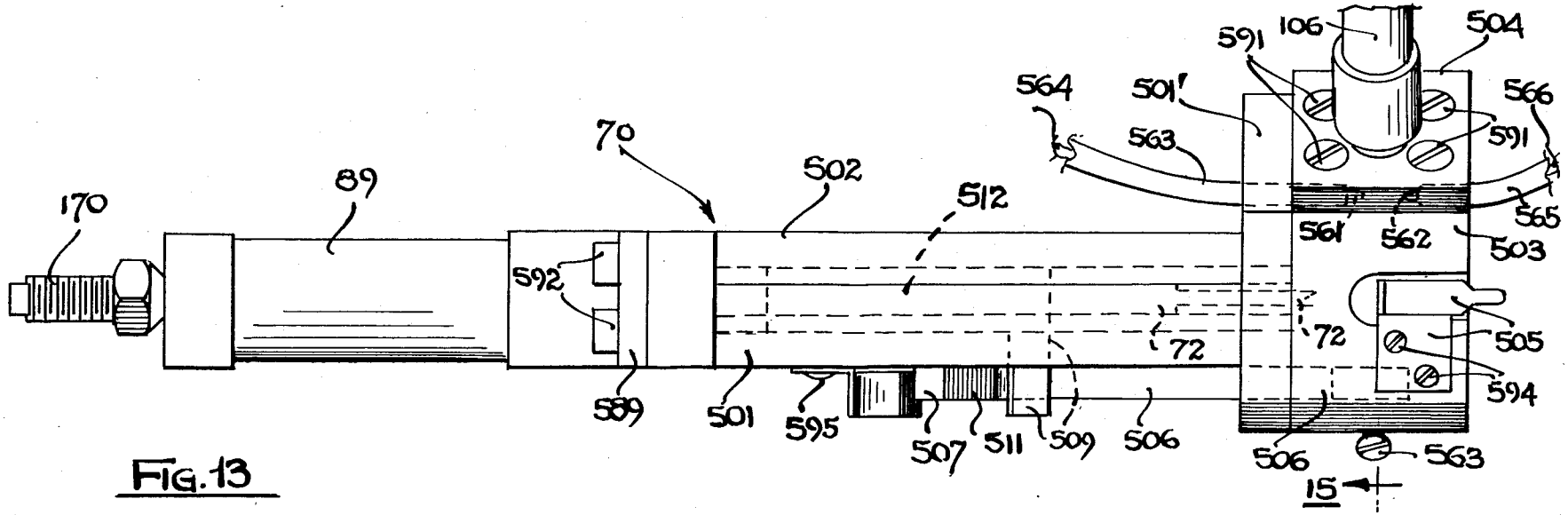
FIG. 13 is a plan of the same injector, likewise showing some internal components in dashed line.
Figure 12:
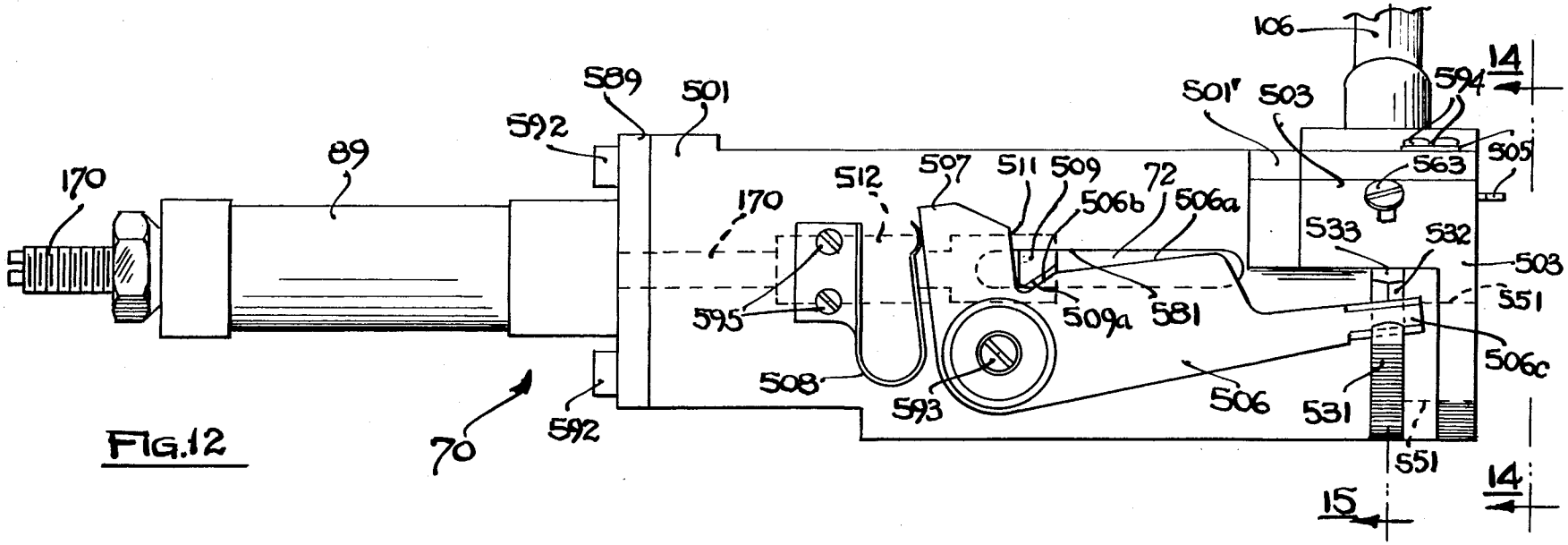
FIG. 12 is a side elevation of the injector shown in FIG. 11, showing some internal components in dashed line.

FIG. 11 illustrates the injector features by which it receives rivets through the supply tube 106, which is secured to the injector by an adjustable adapter block 504; and injects rivets into the gripping fingers of a riveting machine, through the output port 108 in the forward case section 503. The moving parts of the injector are controlled by the drive rod 170 of an air cylinder 89, whose attachment flange 589 is affixed to the rearward end of the injector as by screws 592 (FIGS. 12 and 13). The right-hand section 501 (as viewed from the air-cylinder end of the injector) has a forward enlargement 501' for ease of attachment to the forward section 503 of the case.

A slot 581 is cut through the side wall of the half-case 501 as shown in FIGS. 11 and 12, to accommodate longitudinal passage of a transverse clevis 509. This clevis thereby transmits motion from a longitudinally advancing drive structure 72 (driven by the drive rod 170) within the case 501-502, to the cam surface **506*a* of a lever 506 that is pivotally mounted at 593 to the outside of the half-case 501**.

Also visible in FIG. 11 are a spring 508 that acts on a rearward arm 507 of the lever 506, to bias the cam surface **506*a* of the lever 506 downward; a rivet-head retaining spring 505, mounted to the forward section 503 as by screws 594; adjustable stop screw 563 to limit the action of an internal part within the forward section 503; and a slotted bushing 551** which, as will be seen, is integral with that internal part. The operation and significance of all these components is described below.

FIG. **11*a* shows that the outermost length of the clevis 509 is advantageously cut away at its forward underside, to form a cam-driving surface 509*a*. FIG. 11*b* shows that the upper surface of the forward arm of the lever 506 actually has two sections: first an abruptly rising portion 506*b*, then a long, gradually tapering portion 506*a*. The cut away portion 509*a* of the clevis and the steeply rising initial section 506*b* of the lever provide a positive camming action of the device that may be regarded as a refinement, for reasons that will be explained. The forward tip 506*c* of the lever 506** is generally hexagonal or round in cross-section.

Operation of the injector is a two-stage sequence, and the provision of the various components reflects the separate character of the two stages. The first stage encompasses acceptance of a rivet, verification of its general shape and orientation, and moving it into position for the second stage. The second stage is the actual injection of the rivet into the gripping fingers of the riveting-machine head.

The first stage is effected primarily by a specially shaped rotary component, within the forward section 503, whose lower, outer edge is only partial visible at 531-532-533 in FIG. 12. This component is here called a "rotary spindle." It is visible end-on in FIG. 14 (in dashed line) and FIG. 15.

Viewed end-on, the rotary spindle 530 has a complicated shape, consisting of (1) a straight segment 531, leading to (2) a notch 532 which receives the hexagonal or round tip 506 of the previously mentioned lever arm 506, then (3) a circular segment 533, (4) a straight segment 552, (5) another circular segment 554 of greater radius than the first circular segment 533, (6) a contoured notch consisting of opposing straight sides 539, inwardly angled sides 537, and a tall slot 538 which extends to the center of the spindle 530, (7) another circular segment **554*a* that forms the extension of the second circular segment 554, (8) another straight segment 553-535, and finally (9) another circular segment 534 of small radius, leading back to the straight segment 531** initially mentioned.

In addition the rotary spindle 530 is integral with a bushing 551 (FIGS. 11, and 14 through 16) which imparts the capability for smooth rotary motion of the spindle 530. The bushing passes through and rotates in the front section 503 of the case.

The greater-radius parts 552, 554, **554*a* and 553 of the spindle form a flange segment 536 of the spindle. This flange segment is also of greater thickness, as may be seen in FIG. 16. The slot 539-537-538 which is formed in the spindle thus has a portion near its outer end which is "wider" in both the longitudinal and transverse directions than the lower portion—by virtue of the greater thickness of the flange 536, and the greater separation of the slot walls 539**, respectively.

Figure 14:
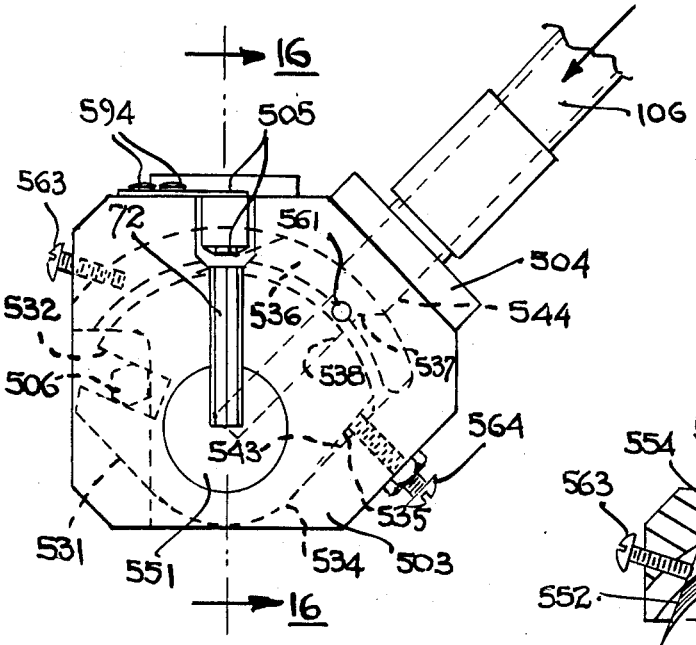
FIG. 14 is an end elevation of the same injector, similarly illustrated, taken along the line 14—14 of FIG. 12.

Thus, when the rivet enters the injector through the delivery tube 106, with the rotary spindle rotated to the position shown in FIG. 14, the shank of the rivet enters the narrower, lower portion 538 of the slot in the spindle, and the head of the rivet is stopped at and suspended by the tapered edges 537 near the wider, upper portion 539 of the slot. Because of the greater thickness of the flange 536, and the mating internal surfaces of the forward section 503, the rivet head passes freely into the upper portion 539 of the slot while the rivet shank is closely constrained within the lower portion 538 of the slot. Thus the slot in the spindle, in combination with the adjacent interior walls of the forward section 503, forms a contoured intake pocket for receiving one rivet at a time from the delivery path 106, when the spindle is rotated to its receiving position.

When a rivet has been delivered to the injector, an automatic monitor is actuated to determine whether it is indeed oriented as described in the preceding paragraph. This monitor consists of a light source and detector (not shown) which are optically coupled to the remote ends of optic fibers 564 and 566 (FIG. 13), which are led within sheaths 563 and 565 into the forward section 503 of the injector. The tips of the two fibers are presented respectively to holes 561 and 562 (FIGS. 13, 14 and 15), which are formed in the forward section 503 at the two opposing sides of the slot 538 in the rotary spindle—just below the tapered portions 537 of the slot.

With the spindle 530 still in the position shown in FIG. 14, the light beam between the two fibers is interrupted if a rivet of proper orientation has been delivered to the pocket in the rotary spindle 530; interruption of the light beam causes a change in the electrical output signal of the optical detector. This change is used to generate a satisfactory-condition signal, and the programmable controller is programmed to respond to this signal by continuing the rivet-installing sequence. If no rivet has been delivered, or if a rivet has been delivered inverted, the light beam is not interrupted, but the installation sequence is.

Once the satisfactory-condition signal has been received, the programmable controller actuates the air cylinder 89, and the drive rod 170 of the cylinder advances into an internal cavity 582 (FIG. 16) of the case 501–502. The rod 170 is threaded into an internal link member 512, which is in turn secured within a cutout 514 in a linear shuttle 72. Some of these parts appear in FIG. 13. From that drawing it may be seen that the shuttle 72 forms a narrower blade at its forward end, to fit through the narrow lower portion 538 (FIGS. 14 and 15) of the slot in the rotary spindle 530; and is broader aft of that so as to form a structurally substantial section into which the intermediate link 512 fits.

As the rod 170 begins its advance, it advances the link 512 and with it the shuttle 72. The link 512 is notched at 513 to engage the transverse clevis 509, which therefore is likewise advanced by the rod 170. At the outset the camming surface 509*a* (FIGS. 11, 11*a* and 12) of the clevis 509 rotates the lever rather abruptly, by pushing on the cam surface 506*b* (FIGS. 11*b* and 12). The lever in turn rotates the rotary spindle 530 from the position shown in FIG. 14 to that shown in FIG. 15, in which the rivet in the pocket is vertical and aligned with the shuttle blade 72. The direction of this motion is indicated by the arrow 542 in FIG. 15.

Figure 15:
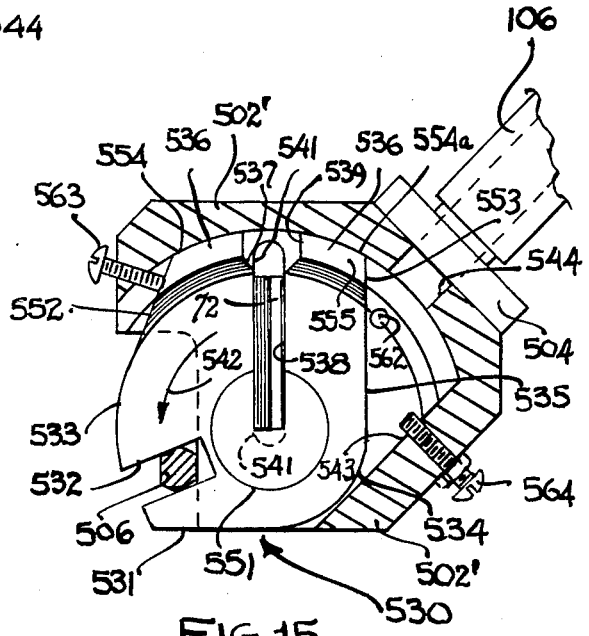
FIG. 15 is an end elevation of the same injector but taken along the line 15—15 of FIG. 12, and consequently largely in section.
Figure 16:
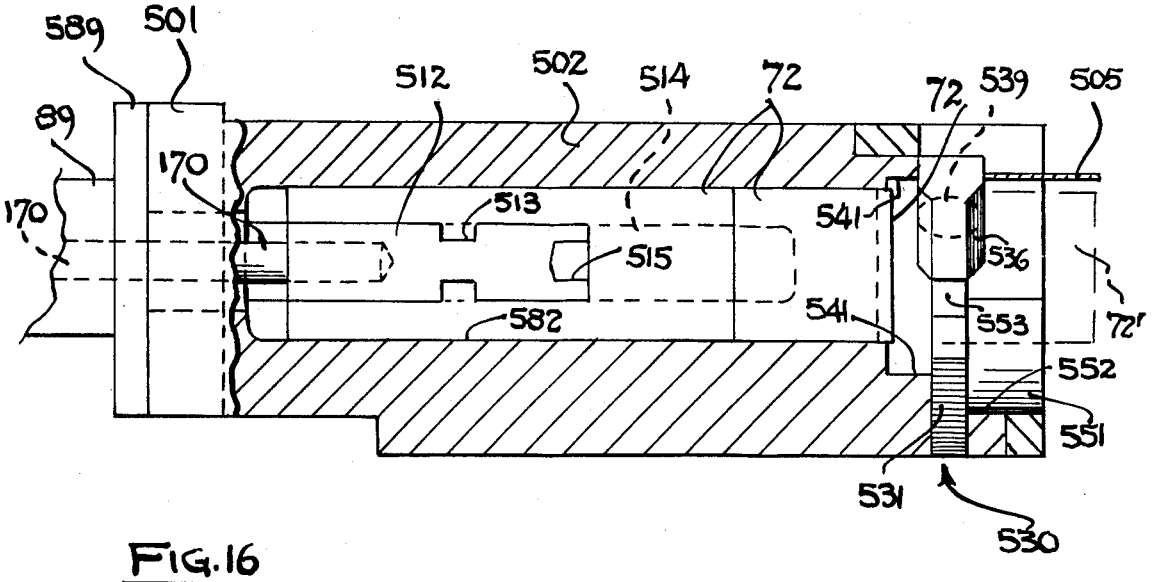
FIG. 16 is a side elevation of the same injector, taken along the line 16—16 of FIG. 14 and largely in section.

When the camming surface 509*a* reaches the second segment 506*a* of the lever cam surface, the spindle 530 is almost fully rotated to the position of FIG. 15. The cam surface 506*a* is shaped so that the slot 538 in the spindle 530 just fully aligns with the shuttle blade 72 when the notched tip of the shuttle blade 72 has advanced to the position of the spindle.

As previously mentioned, the dual-segment shape of the cam surface 506*a*–506*b* and the cut-away character of the clevis at 509*a* may be regarded as refinements. The spring 508 is in general practice adequate to advance the lever arm 506 and with it the rotary spindle 530, to position the spindle for the through-motion of the shuttle. Therefore, based on our observations of a prototype apparatus in operation for an extended period, the clevis may be continued with its square cross-section to its tip, and the abruptly rising portion 506*b* of the camming surface may be dispensed with. We are concerned, however, that in even more extended use the spindle may possibly develop some frictional resistance—due to dirt or wear—sufficient to overcome the spring. We therefore consider positive camming of the spindle rotation extremely desirable.

It is essential to rotate the spindle between a first position (FIG. 14) that is precisely aligned with the delivery tube 106 and a second position (FIG. 15) that is precisely aligned with the shuttle 72—and with the slot 108 in the forward section 503. The precision of these alignments is ensured by forming the forward section 503 of the case in such a way that it does *not* delimit the rotary motion of the injector at either end of its operation, and by providing adjustable stops such as screws 563 and 564 that *do* delimit that rotary motion. Lock-nuts may be provided for such stop-screws as appropriate.

When the shuttle advances through the slot in the spindle, it carries the captured rivet with it—the shank of the rivet fitting into the notched end of the shuttle, and the head of the rivet being held down against the top of the shuttle by the hold-down spring 505. The rivet is thereby delivered to the gripping fingers of the riveting head, with continuous, positive control of its orientation at all points along the path—from supply bowls to gripping fingers.

Once the rivet is delivered, the injector shuttle is actuated rearwardly, and the upper arm 511 of the lever 506 is forced counterclockwise (as drawn in FIGS. 11, 11*b* and 12) by the rearward action of the clevis 509.

The Stack-Thickness Indicator

Figure 17:
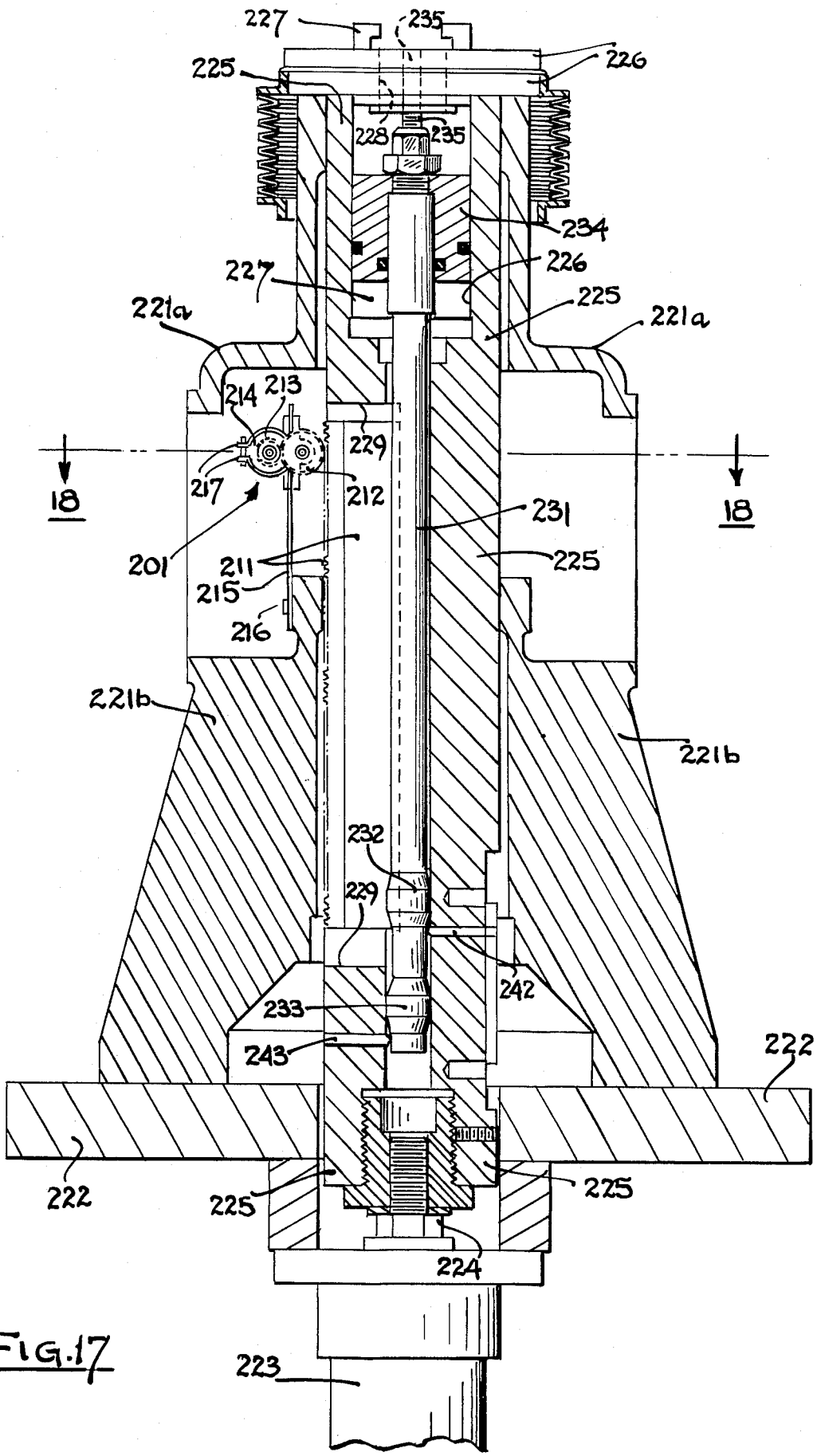
FIG. 17 is a side elevation of a lower ram assembly of a riveting machine according to my invention, particularly showing the disposition of components of a stack-thickness indicator which forms a preferred embodiment. This drawing is largely in section, being taken through the centerline of the ram assembly.

FIG. 17 illustrates the hardware components (that is, other than the programmed microprocessor) of the stack-thickness indicator, in the context of a concentric-ram probe system. The apparatus shown in FIG. 17 is all positioned beneath the riveting head, and in fact beneath the workpiece, as shown generally at 201 in FIG. 19.

What is illustrated in FIG. 17 is a support table 222, and suspended below it a hydraulic cylinder 223 that effects rivet upset—as well as supplying motive force for the clamping operation which is about to be described. The drive rod 224 of the cylinder supports a main ram rod 225, which has a rather complicated shape as shown. The main ram 225 extends almost to the very top of the drawing. There, as shown, it supports a turntable 226, to which tooling is clamped by a clamp 227.

The main ram 225 is slidably movable vertically within a housing 221*a*–221*b*. Disposed for sliding vertical motion within the main ram 225 is a probe rod or secondary ram 231, which at its lower end carries actuating cams 232 and 233 and near its upper end is suspended from an air pison 234. The piston 234 runs vertically in a hollow chamber 226 within the upper portion of the main ram 225, and is provided with seals so that the air in closed chamber 227 cannot escape quickly. This air forms an air cushion which resiliently supports the piston and the probe rod above the bottom of the chamber 227 in the main ram 225. At the extreme top of the probe rod 231 is a probe tip 235, which is configured for passage through a hole 228 in the turntable 226.

Attached atop the probe tip 235 is an extension element (not shown) that may be considered part of the tooling for the particular job, since its shape, length, and so forth varies with the geometry of the workpiece. This tooling extension is provided to effect contact between the probe tip 235 and the underside of the workpiece, when the latter is in position in the riveting apparatus—or the underside of a gauge block for calibration, when the workpiece is out of the way.

The main ram 225 is cut away at 229 to provide access from the outside of the apparatus to the probe rod 231. Mounted to the probe rod and disposed to pass through the cut-away window 229 in the ram 225 is a high-precision linear rack 211. In engagement with this rack 211 is an idler gear 212, which is supported from the housing 221*b* by a suitable support member such as 215, secured to the housing as at 216. Vertical motion of the probe rod 231 relative to the housing 221*b* therefore causes rotation of the idler pinion 212 by the rack 211.

The idler 212 in turn is coupled to a drive pinion 213 on the shaft of a high-precision encoder 214, which encoder generates a sequence of identical electrical pulses as its shaft is rotated. The idler 212 in our preferred embodiment is provided merely because we prefer to use a small pinion 213 on the encoder, for maximum sensitivity. Using a small drive pinion 213, in turn, requires either positioning the encoder 214 itself very close to the working mechanism, or standing the encoder 214 away from the mechanism by an idler such as 212. As a matter of practical assembly reference we have chosen the latter approach.

We prefer to use an encoder that produces 2000 counts or pulses per revolution. Various such units available commercially—such as the Disc Instrument model 882-2000-OBLP-TTL—satisfy this requirement, with extreme linearity and precision. The pitch diameter of the encoder pinion is 0.6366197; it is a one-tenth circular-pitch (1/10 CP) twenty-tooth precision gear. The rack is a precision unit, one-tenth (0.100) inch between teeth, such as that available from the PIC company. The result is exactly two inches of vertical probe travel per rotation of the encoder shaft—or two inches of travel per 2000 counts. One count therefore represents one thousandth (0.001) of an inch.

In operation, when the workpiece has been moved into position for insertion of a rivet at a particular location, the hydraulic cylinder 223 raises the main ram 225—and with it the probe rod 231—until the earlier-mentioned tooling extension above the probe tip 235 comes into contact with the underside of the workpiece. At that point the probe rod 231 is stopped by the workpiece, but the main ram 225 continues to rise until the cam-follower pin 242, near the bottom of the main ram, reaches the cam 232 on the probe rod 231.

Figure 18:
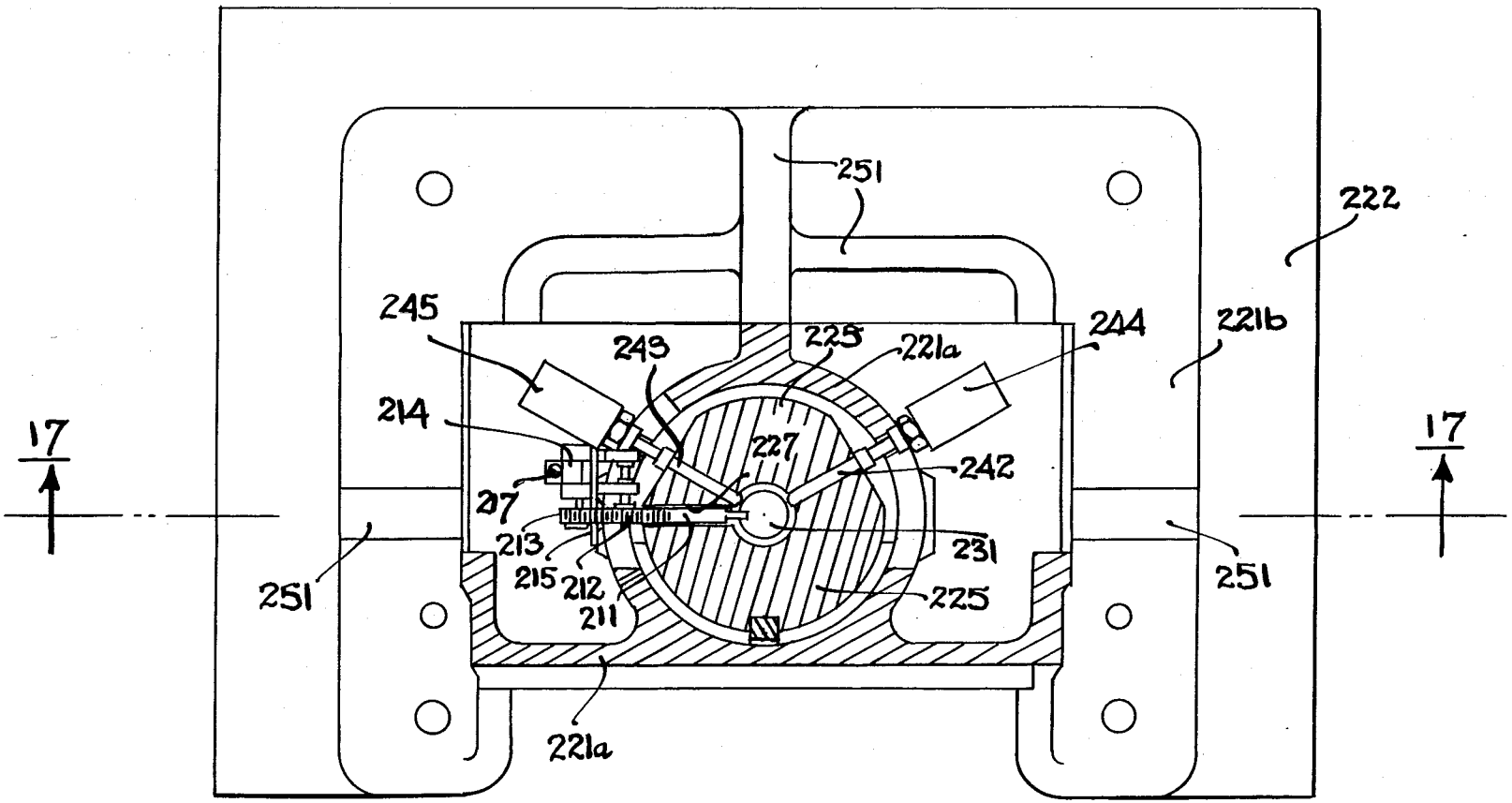
FIG. 18 is a plan of the same ram assembly, taken along the line 18—18 of FIG. 17, and largely in section.

When the follower pin 242 reaches the cam 232, the cam 232 pushes the pin 242 radially outward to operate a microswitch 244 (FIG. 18). The switch 244, in turn, signals the programmable controller (and thereby the microprocessor) that the system is in condition for a measurement. The controller halts the upward advance of the hydraulic-cylinder drive rod 224, holding the main ram 225 in the vertical position at which the cam 232 actuates the cam 242. The probe rod 231 and pin 235, meanwhile, remain in position: they are stopped against the underside of the workpiece, and so cannot rise further; and they are suspended by the compressed air at 227 in the chamber 226 mentioned earlier, and so cannot fall.

Only a virtually instantaneous pause in this position is required, since the encoder pulses have been accumulated and counted in the microprocessor during the rise of the probe rod, and it is only necessary for the programmable controller to signal the microprocessor to accept the number of pulses already accumulated as the final value for the measurement.

Figure 19:
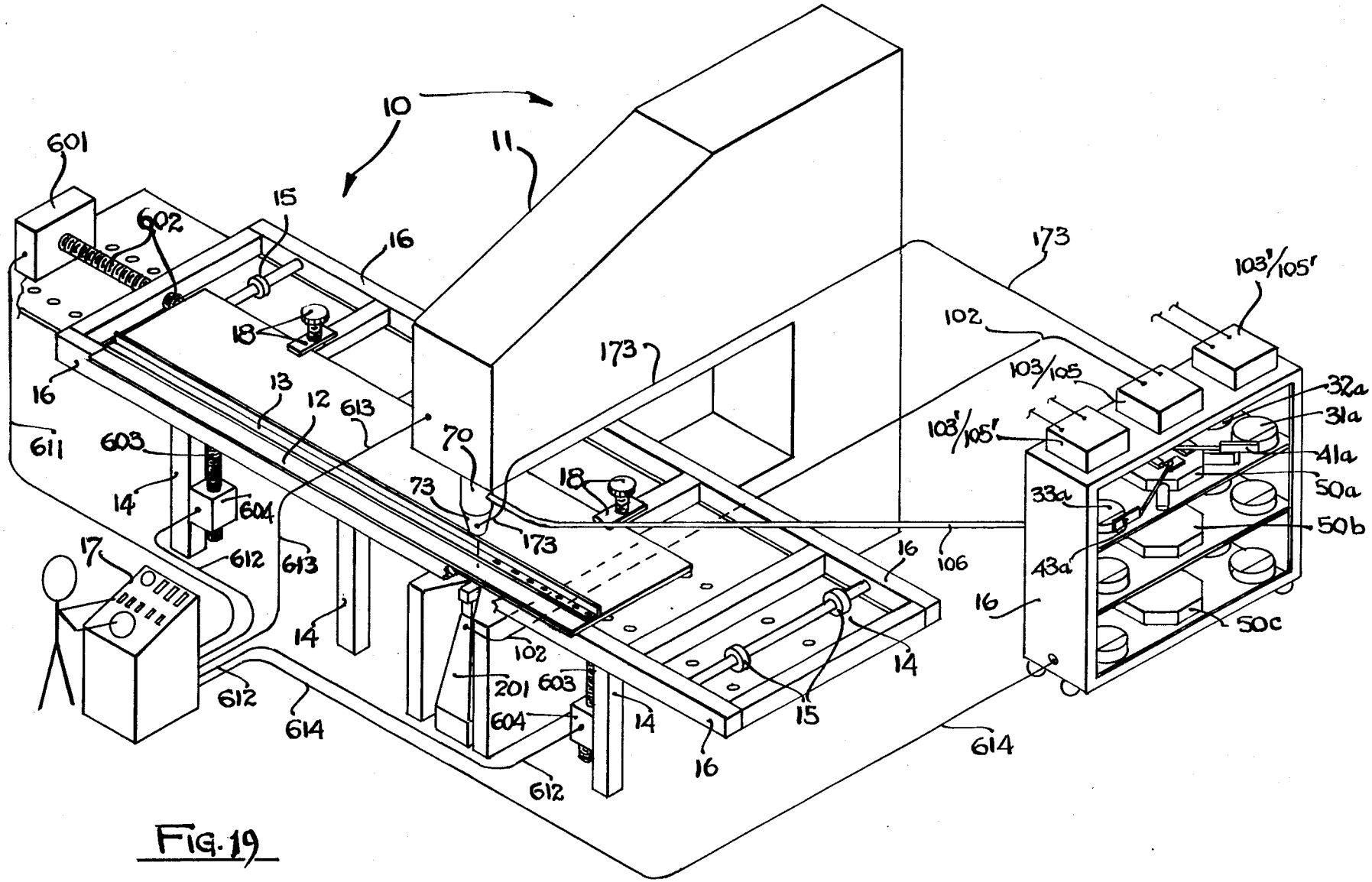
FIG. 19 is a highly symbolic or schematic perspective view of an entire riveting machine in accordance with my invention.

The system then responds by selecting, delivering and upsetting a suitable rivet, as previously described. The main ram 225 then descends carrying with it the probe rod 231 and the precision rack 211. During this descent the encoder 214 and microprocessor continue to keep track of the probe-rod position relative to the table 222—and thus relative to the pressure-foot bushing, which is fixed relative to the table 222 by the "C" frame 11 (FIG. 19).

The Microprocessor and the Programmable Controller

The functions, relative to overall system operation, of these two devices are described in some detail in sections 1 and 2 of this detailed description.

The microprocessor 103 and programmable controller 105 (FIG. 1) are readily configured and programmed to perform all the described functions for the preferred embodiments of FIGS. 1 through 3, using a level of skill that is well within the state of the art in microprocessor and programmer design and programming. Thus the details of configuration and programming of these devices need not be included here.

8. The Riveting Machine

As already noted, one conceptualization of our invention encompasses a riveting machine complete with the feed system that has already been described.

FIG. 19 illustrates in a highly schematic or symbolic way such a complete riveting machine. As there shown, the machine has a support structure or "support means," consisting of a movable framework or table 16 supported by wheels 15 upon a stationary table 14, together with clamps or cleats 18. These support means are provided for movably supporting and retaining the workpiece—that is, the article under manufacture—in positions appropriate for riveting.

The machine also has some means for facilitating the loading of the article (that is to say, its unriveted pieces) into or onto the support means in preparation for riveting, and for facilitating the unloading of the article from the support means after riveting. These "loading and unloading means" may, for example, take the form of adjustable jacks 603–604, or adjustable elevators or adjustable ramps (not shown)—or may be merely guides or rollers (not shown), not used while the actual riveting operation is proceeding, with which workers can more readily put the unriveted pieces into place and/or remove the finished work. Modernly, relatively sophisticated devices, such as a dolly-actuated scissors lift, are preferable. In FIG. 19, however, such loading and unloading means are symbolized, merely for purposes of illustration simplicity, by vertical leadscrews 603 and remote-controlled powering units 604.

In addition the machine has an installing head at 70, supported by a large "C" frame 11, for installation and "upset" of the rivets in the many rivet locations in the article. The term "upset" is understood in the riveting industry to mean the squeezing of the shank of a conventional rivet (after the rivet has been inserted into a hole, with the shank protruding from the surface of the workpiece remote from the rivet head), to deform the shank into a flange and thereby form a permanent fastening structure. Here, however, the term "upset" is further to be understood to encompass any other modern equivalent of such deformation—such as, for instance, the spinning of a thread-cutting nut onto the chank of a rivet-like structure, to form a permanent fastener.

The riveting machine also has means for advancing the article under manufacture, while that article is held in the support means mentioned earlier, so that each of the intended rivet locations is brought in turn into alignment with the installing head. Here the advancing means are symbolized by a leadscrew 602 that is threaded through an end cross-member of the movable table 16, and that is rotated by a remote-controlled powering unit 601.

The machine also has an operational control console 17, and interconnecting control signal paths 613 between the control console and the installing head—and between the control console and the advance means 601–602 just mentioned, and between the control console and the jacks 603–604 mentioned previously. These interconnecting control signal paths include any status-monitoring equipment at the installing head, and status-feedback-signal paths from the status-monitoring equipment to the control console.

In some cases all of this control equipment may be quite simple and almost primitive—perhaps no more than an actuating switch for the installing head and another for the workpiece advance mechanism, with a limit switch or position indicator on the advance mechanism to aid the operator in positioning the workpiece properly and in avoiding overtravel of the advance mechanism or of the workpiece. In other cases the control equipment may be very sophisticated.

In all these cases, however, the control equipment serves as part of our invention in that it facilitates the achievement of the unique results provided by our invention—namely, an extremely reliable, high-speed installation of rivets having a very wide variety of characteristics as *respectively* required for particular locations in articles under manufacture.

Finally, the riveting machine of our invention includes the measuring means 201, storage containers 31*a*, 32*a*, 33*a*, etc., removal devices 41*a*, 43*a*, etc., selection means 103/105 (representing both the microprocessor 103 and programmable controller 105, of FIG. 1), delivery path 106, transfer means 50*a*, 50*b*, etc., and injector 70, in any of the various embodiments and/or combinations of embodiments discussed above.

It is to be understood that all of the foregoing detailed descriptions are by way of example only, and not to be taken as limiting the scope of our invention—which is expressed only in the appended claims.

We claim:

1. A system for feeding rivets, each having a respective axis of symmetry and having various rivet parameters including length of such rivets, to the installing head of a riveting machine for installation into a plurality of locations in an article under manufacture by insertion of each such rivet parallel to its axis of symmetry of such rivet into such article, followed by upset of such rivet, such locations having correspondingly various location parameters including thickness of such article; such installing head being subject to limited clearance within the mouth of such riveting machine; said system comprising:

automatic measuring means for measuring such location parameters for each one of such locations in turn;

a plurality of storage containers, each container being adapted for storage of a multiplicity of such rivets having a particular set of such rivet parameters in common;

a plurality of removal devices, each device being associated with a respective one of the storage containers for removing such rivets from its associated storage container;

means defining a delivery path linking the transfer station, recited hereunder, with the injector, also recited hereunder;

at least one transfer station having a plurality of independently actuable transfer devices; each transfer device being associated with a respective one of the plurality of removal devices and including:

means for receiving such rivets from its associated removal device, and means for automatically transferring such rivets into the delivery path;

whereby each different transfer device of the plurality may be identified with a different set of such rivet parameters, corresponding to such rivet parameters of rivets received from the associated removal device and storage container;

each transfer device being actuable exclusively through a short rectilinear stroke, to effect transfer motions that are defined exclusively by alignment of two positive stops associated with each transfer device;

automatic selection means, responsive to the measuring means, for determining and selecting a set of such rivet parameters which corresponds to such measured location parameters, for each one of such locations in turn, and for selecting a transfer device identified with that set of such rivet parameters;

automatic actuating means, responsive to the selection means, for automatically actuating the selected transfer devices in turn; and an injector for receiving such rivets from the selected transfer device, via the delivery path, and for presenting such received rivets, one at a time in a controlled attitude, to such installing head, said injector comprising:

means for accepting each such rivet from the delivery path by translation of such rivet substantially parallel to its axis of symmetry and at a substantial angle to the direction of upset, and means for moving each such rivet, from the position in which it is accepted, through at least one substantial angle into a feed position wherein its axis of symmetry is substantially parallel to the upset direction;

whereby one such rivet, having such rivet parameters selected by the selection means as corresponding to the location parameters for each particular location, is delivered to such installing head in proper orientation for insertion and upset in that particular location, despite such limited clearance within the mouth of the riveting machine.

2. The system of claim 1, wherein:

the injector also comprises means for feeding each such rivet from the feed position to such installing head while such rivet remains substantially parallel to the upset direction.

3. A system for feeding rivets, each having a respective axis of symmetry and having various rivet parameters including length of such rivets, to the installing head of a riveting machine for installation into a plurality of locations in an article under manufacture by insertion of each such rivet parallel to its axis of symmetry of such rivet into such article, followed by upset of such rivet, such locations having correspondingly various location parameters including thickness of such article; said system comprising:

automatic measuring means for measuring such location parameters for each one of such locations in turn;

a plurality of storage containers, each container being adapted for storage of a multiplicity of such rivets having a particular set of such rivet parameters in common;

a plurality of removal devices, each device being associated with a respective one of the storage containers for removing such rivets from its associated storage container, and each device defining a respective removal path from the associated storage container to the transfer station, recited hereunder; each removal path including:

a first portion in which each such rivet, isolated from contact with all other such rivets, nominally translates perpendicular to its axis of symmetry, and a second portion in which each such rivet nominally translates parallel to its axis of symmetry;

each said device also including means for controlling the attitude of each such rivet in passage from the first to the second portion of the removal path to prevent each such rivet from toppling into the second portion;

means defining a delivery path linking the transfer station, recited hereunder, with the injector, also recited hereunder;

at least one transfer station having a plurality of independently actuable transfer devices; each transfer device being associated with a respective one of the plurality of removal devices and including:

respective separate means for receiving such rivets from its associated removal device, and means for automatically transferring such rivets into the delivery path;

whereby each different transfer device of the plurality may be identified with a different set of such rivet parameters, corresponding to such rivet parameters of rivets received from the associated removal device and storage container;

each transfer device:

being actuable exclusively through a short rectilinear stroke, to effect transfer motions that are defined exclusively by alignment of two positive stops associated with each transfer device, and transferring such rivets to substantially the same release point along the delivery path as each other transfer device of the plurality so that none of such rivets after release passes through any other transfer device;

automatic selection means, responsive to the measuring means, for determining and selecting a set of such rivet parameters which corresponds to such measured location parameters, for each one of such locations in turn, and for selecting a transfer device identified with that set of such rivet parameters;

automatic actuating means, responsive to the selection means, for automatically actuating the selected transfer devices in turn; and an injector for receiving such rivets from the selected transfer device, via the delivery path, and for presenting such received rivets, one at a time in a controlled attitude, to such installing head, said injector comprising:

means for accepting each such rivet from the delivery path by translation of such rivet substantially parallel to its axis of symmetry and at a substantial angle to the direction of upset, and means for moving each such rivet, from the position in which it is accepted, through at least one substantial angle into a feed position wherein its axis of symmetry is substantially parallel to the upset direction;

whereby one such rivet, having such rivet parameters selected by the selection means as corresponding to the location parameters for each particular location, is delivered to such installing head for insertion and upset in that particular location.

4. The system of claim 3, also comprising:

control means, responsive to automatic actuation of a particular transfer device by the automatic actuation means, for automatically causing that same particular transfer device to receive another such rivet from the associated removal device and storage means before the actuating means again actuate any of the transfer devices.

5. The system of claim 4:

also comprising means, responsive to the measuring device by way of the selection means and actuating means, for causing one transfer device of the transfer station to transfers into the delivery path one such rivet of parameters appropriate to the particular location; and wherein the aforesaid control means further comprise:

means, responsive to completion of the transfer of such rivet, for causing the same transfer device to generate a resupply signal, and means, responsive to the resupply signal, for causing the removal device associated with that same transfer device to supply another such rivet of the same parameters from the associated storage means to that same transfer device;

whereby during continuing operation of the system each transfer device that is not in the process of transferring such a rivet to the delivery path always has such a rivet ready to transfer.

6. The system of claim 3, wherein:

the attitude-controlling means of each said transfer device comprise means for restraining the shank of such rivet from tipping rearwardly into the first portion of the removal path through which such rivet has already passed;

whereby the head of such rivet has inadequate room to fall forwardly into the second portion of the removal path, and whereby the shank and head of such rivet are forced to enter the second portion of the removal path substantially simultaneously so that such rivet enters the second portion of the removal path with its axis of symmetry aligned parallel to the second portion of the removal path.

7. The system of claim 3, wherein:

the attitude-controlling means of each said transfer device comprise mechanical means for, while translating each rivet in turn along the first portion of the removal path, confining the shank of such rivet in a space only slightly larger than the shank diameter, as measured parallel to the first portion of the removal path.

8. The system of claim 7, wherein:

the mechanical confining means comprise two separate parts that are spaced apart by:

a first controlled distance to define said space while translating such rivet along the first portion, and a second controlled distance that is larger than the head of such rivet while releasing such rivet into the second portion of the removal path.

9. The system of claim 3, wherein:

the receiving means of each transfer device receive each such rivet from its associated removal device solely by translation of such rivet substantially parallel with the axis of symmetry of such rivet, and the releasing means of each transfer device release each such rivet into the delivery path solely by translation substantially parallel with the axis of symmetry of such rivet.

10. The system of claim 3, wherein:

for each transfer station, all the transfer-device rectilinear strokes are in substantially the same horizontal plane.

11. The system of claim 3, wherein:

the injector also comprises means for feeding each such rivet from the feed position to such installing head while such rivet remains substantially parallel to the upset direction.

12. A system for feeding rivets to the installing head of a riveting machine, for installing rivets having various rivet parameters into a plurality of locations in an article under manufacture, such locations having correspondingly various location parameters; such installing head being subject to limited clearance within the mouth of such riveting machine, and being particularly adapted to insert and upset such rivets; said system comprising:

automatic measuring means, mounted in proximity to such installing head, for measuring such location parameters for each one of such locations;

a plurality of storage containers, mounted remote from such installing head, each container being adapted for storage of a multiplicity of such rivets having a particular set of such rivet parameters in common, and such container being accordingly identified with a particular set of such rivet parameters, respectively;

a plurality of removal devices; each device being associated with and mounted adjacent to a respective one of the storage containers for removing such rivets with positive control of rivet orientation from its associated storage container;

automatic selection means, responsive to the measuring means, for determining and selecting a set of such rivet parameters which corresponds to such measured location parameters, for each one of such locations in turn;

means defining a pneumatic delivery path terminating in close proximity to such installing head, and means for supplying pressurized gas to propel such rivets along the delivery path;

transfer means, mounted remote from such installing head and responsive to the selection means, for receiving, with positive control of rivet orientation, rivets from that removal device which is identified with the particular set of rivet parameters selected by the automatic selection means, and for automatically transferring such received rivets into the pneumatic delivery path, while maintaining positive control of rivet orientation; and an injector, mounted in close proximity to such installing head, and comprising:

means for accepting each such selected rivet from the pneumatic delivery path by translation of such rivet substantially parallel to its axis of symmetry and at a substantial angle to the direction of upset, with positive control of rivet orientation, and means for moving each such rivet from the position in which it is accepted through at least one substantial angle into a feed position wherein its axis of symmetry is substantially parallel to the upset direction, and for presenting such selected rivets in the feed position, one at a time with positive control of rivet orientation, to such installing head;

whereby one such rivet, having such rivet parameters selected by the selection means as corresponding to the location parameters for each particular location, is delivered to such installing head in proper orientation for insertion and upset in that particular location, despite such limited clearance within the mouth of the riveting machine.

13. The system of claim 12, also comprising:

control means, responsive to transfer of a rivet from a particular removal device and storage means to the delivery tube by the automatic transfer means, for automatically causing the automatic transfer means to receive another such rivet from the same removal device and storage means before the automatic transfer means again transfer any other rivet to the delivery tube.

14. The system of claim 12, also comprising:

means defining a plurality of pneumatic supply paths, one between each removal device and the transfer means.

15. A riveting machine for installing rivets having various rivet parameters into a plurality of locations in an article under manufacture, such locations having correspondingly various location parameters; said riveting machine comprising:

support means for movably supporting and retaining such article in positions for riveting;

an installing head for installation and upset of such rivets at such plurality of locations in such article, said installing head being subject to limited clearance within the mouth of such riveting machine, and being particularly adapted to insert and upset such rivets;

automatic measuring means for measuring such location parameters for each one of such locations in turn;

a plurality of storage containers, each container being adapted for storage of a multiplicity of such rivets having a particular set of such rivet parameters in common;

a plurality of removal devices; each device being associated with a respective one of the storage containers for removing such rivets from its associated storage container;

means defining a delivery path linking the transfer station, recited hereunder, with the injector, also recited hereunder;

at least one transfer station having a plurality of independently actuable transfer devices; each transfer device being associated with a respective one of the plurality of removal devices and, when selected and actuated:

receiving such rivets from its associated removal device, and automatically transferring such rivets into the delivery path;

whereby each different transfer device of the plurality may be identified with a different set of such rivet parameters, corresponding to such rivet parameters of rivets received from the associated removal device and storage container;

each such transfer device being actuable exclusively through a short rectilinear stroke, to effect transfer motions that are defined exclusively by alignment of two positive stops associated with each transfer device;

automatic selection means, responsive to the measuring means, for determining and selecting a set of such rivet parameters which correspond to such measured location parameters, for each one of such locations in turn, and for selecting a transfer device identified with that set of such rivet parameters;

automatic actuating means, responsive to the selection means, for automatically actuating the selected transfer devices in turn; and an injector for receiving such rivets from the selected transfer device, via the delivery path, and comprising:

means for accepting each such rivet from the delivery path by translation of such rivet substantially parallel to its axis of symmetry and at a substantial angle to the direction of upset; and means for moving each such rivet from the position in which it is accepted through at least one substantial angle into a feed position wherein its axis of symmetry is substantially parallel to the upset direction, and for presenting such received rivets in the feed position, one at a time in a controlled attitude, to such installing head;

whereby one such rivet, having such rivet parameters selected by the selection means as corresponding to the location parameters for each particular location, is delivered to such installing head in proper orientation for insertion and upset in that particular location, and is installed into such article and upset in that particular location, despite such limited clearance within the mouth of the riveting machine.

16. The riveting machine of claim 15, also comprising:

an operational control console and interconnecting control signal paths between the control console and the installing head, and between the control console and the advance means, including status monitoring equipment at the installing head and status feedback signal paths from the status monitoring equipment to the control console.

17. The riveting machine of claim 16, also comprising:

advance means for advancing such article while such article is held in the support means, to bring each of such plurality of locations in turn into alignment with the installing head.

18. The riveting machine of claim 17, also comprising:

loading and unloading means for facilitating the loading of such article into or onto the support means for riveting, and for facilitating the unloading of such article from the support means after riveting.

19. The riveting machine of claim 15, also comprising:

automatic means for drilling holes in such article at said plurality of locations.

20. A system for feeding rivets, each having a respective axis of symmetry and having various rivet parameters including length of such rivets, to the installing head of a riveting machine for installation into a plurality of locations in an article under manufacture by insertion of each such rivet parallel to its axis of symmetry of such rivet into such article, followed by upset of such rivet, such locations having correspondingly various location parameters including thickness of such article; said system comprising:

automatic measuring means for measuring such location parameters for each one of such locations in turn;

a plurality of storage containers, each container being adapted for storage of a multiplicity of such rivets having a particular set of such rivet parameters in common;

a plurality of removal devices, each device being associated with a respective one of the storage containers for removing such rivets from its associated storage container, and each device defining a respective removal path from the associated storage container to the transfer station, recited hereunder; each removal path including:

a first portion in which each such rivet, isolated from contact with all other such rivets, nominally translates perpendicular to its axis of symmetry, and a second portion in which each such rivet nominally translates parallel to its axis of symmetry;

each said device also including means for controlling the attitute of each such rivet in passage from the first to the second portion of the removal path to prevent each such rivet from toppling into the second portion;

means defining a delivery path linking the transfer station, recited hereunder, with the injector, also recited hereunder;

at least one transfer station having a plurality of independently actuable transfer devices; each transfer device being associated with a respective one of the plurality of removal devices and including:

means for receiving such rivets from its associated removal device, and means for automatically transferring such rivets into the delivery path;

whereby each different transfer device of the plurality may be identified with a different set of such rivet parameters, corresponding to such rivet parameters of rivets received from the associated removal device and storage container;

each transfer device being actuable exclusively through a short rectilinear stroke, to effect transfer motions that are defined exclusively by alignment of two positive stops associated with each transfer device;

automatic selection means, responsive to the measuring means, for determining and selecting a set of such rivet parameters which corresponds to such measured location parameters, for each one of such locations in turn, and for selecting a transfer device identified with that set of such rivet parameters;

automatic actuating means, responsive to the selection means, for automatically actuating the selected transfer devices in turn; and an injector for receiving such rivets from the selected transfer device, via the delivery path, and for presenting such received rivets, one at a time in a controlled attitude, to such installing head;

whereby one such rivet, having such rivet parameters selected by the selection means as corresponding to the location parameters for each particular location, is delivered to such installing head for insertion and upset in that particular location.

21. The system of claim 20, wherein:

the attitude-controlling means of each said transfer device comprise means for restraining the shank of such rivet from tipping rearwardly into the first portion of the removal path through which such rivet has already passed;

whereby the head of such rivet has inadequate room to fall forwardly into the second portion of the removal path, and whereby the shank and head of such rivet are forced to enter the second portion of the removal path substantially simultaneously so that such rivet enters the second portion of the removal path with its axis of symmetry aligned parallel to the second portion of the removal path.

22. The system of claim 20, wherein:

the attitude-controlling means of each said transfer device comprise mechanical means for, while translating each such rivet in turn along the first portion of the removal path, confining the shank of such rivet in a space only slightly larger than the shank diameter, as measured parallel to the first portion of the removal path.

23. The system of claim 22, wherein:

the mechanical confining means comprise two separate parts that are spaced apart by:

a first controlled distance to define said space while translating such rivet along the first portion, and a second controlled distance that is larger than the head of such rivet while releasing such rivet into the second portion of the removal path.

24. A system for feeding rivets, each having a respective axis of symmetry and having various rivet parameters including length of such rivets, to the installing head of a riveting machine for installation into a plurality of locations in an article under manufacture by insertion of each such rivet parallel to its axis of symmetry of such rivet into such article, followed by upset of such rivet, such locations having correspondingly various location parameters including thickness of such article; said system comprising:

automatic measuring means for measuring such location parameters for each one of such locations in turn;

a plurality of storage containers, each container being adapted for storage of a multiplicity of such rivets having a particular set of such rivet parameters in common;

a plurality of removal devices, each device being associated with a respective one of the storage containers for removing such rivets from its associated storage container;

means defining a delivery path linking the transfer station, recited hereunder, with the injector, also recited hereunder;

at least one transfer station having a plurality of independently actuable transfer devices; each transfer device being associated with a respective one of the plurality of removal devices and including:

respective separate means for receiving such rivets from its associated removal device, and means for automatically transferring such rivets into the delivery path;

whereby each different transfer device of the plurality may be identified with a different set of such rivet parameters, corresponding to such rivet parameters of rivets received from the associated removal device and storage container;

each transfer device:

being actuable exclusively through a short rectilinear stroke, to effect transfer motions that are defined exclusively by alignment of two positive stops associated with each transfer device, and transferring such rivets to substantially the same release point along the delivery path as each other transfer device of the plurality so that none of such rivets after release passes through any other transfer device;

automatic selection means, responsive to the measuring means, for determining and selecting a set of such rivet parameters which corresponds to such measured location parameters, for each one of such locations in turn, and for selecting a transfer device identified with that set of such rivet parameters;

automatic actuating means, responsive to the selection means, for automatically actuating the selected transfer devices in turn; and an injector for receiving such rivets from the selected transfer device, via the delivery path, and for presenting such received rivets, one at a time in a controlled attitude, to such installing head;

whereby one such rivet, having such rivet parameters selected by the selection means as corresponding to the location parameters for each particular location, is delivered to such installing head for insertion and upset in that particular location.

25. The system of claim 24, wherein:

the receiving means of each transfer device receive each such rivet from its associated removal device solely by translation of such rivet substantially parallel with the axis of symmetry of such rivet, and the releasing means of each transfer device release each such rivet into the delivery path solely by translation substantially parallel with the axis of symmetry of such rivet.

26. The system of claim 24, wherein:

for each transfer station, all the transfer-device rectilinear strokes are in substantially the same horizontal plane.

* * * * *